US012006581B2

(12) United States Patent
D'Astolfo, Jr. et al.

(10) Patent No.: US 12,006,581 B2
(45) **Date of Patent: *Jun. 11, 2024**

(54) SYSTEMS AND METHODS FOR PREVENTING THERMITE REACTIONS IN ELECTROLYTIC CELLS

(71) Applicant: ELYSIS LIMITED PARTNERSHIP, Montreal (CA)

(72) Inventors: Leroy E. D'Astolfo, Jr., Lower Burrell, PA (US); William J. Steiner, Acme, PA (US); Eric C. Moreland, Pittsburgh, PA (US); Robert L. Kozarek, Apollo, PA (US); Yimin Ruan, Pittsburgh, PA (US)

(73) Assignee: ELYSIS LIMITED PARTNERSHIP, Montreal (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/988,115

(22) Filed: May 24, 2018

(65) Prior Publication Data

US 2022/0316083 A1 Oct. 6, 2022

Related U.S. Application Data

(63) Continuation of application No. 13/987,650, filed on Aug. 19, 2013, now Pat. No. 9,982,355.

(60) Provisional application No. 61/684,212, filed on Aug. 17, 2012, provisional application No. 61/800,649, filed on Mar. 15, 2013.

(51) Int. Cl.
*C25C 3/20* (2006.01)
*C25C 7/06* (2006.01)

(52) U.S. Cl.
CPC . *C25C 3/20* (2013.01); *C25C 7/06* (2013.01)

(58) Field of Classification Search
CPC ..... C25C 7/06; C25C 3/20; C25C 3/16
See application file for complete search history.

(56) References Cited

U.S. PATENT DOCUMENTS

| | | | |
|---|---|---|---|
| 3,871,984 | A | 3/1975 | Berry, Jr. |
| 3,888,747 | A | 6/1975 | Murphy |
| 3,960,678 | A | 6/1976 | Alder |
| 4,448,660 | A | 5/1984 | Fabian et al. |

(Continued)

FOREIGN PATENT DOCUMENTS

| | | | |
|---|---|---|---|
| CN | 102409362 | A | 4/2012 |
| CN | 202380104 | U | 8/2012 |

(Continued)

OTHER PUBLICATIONS

International Search Report and Written Opinion of the International Searching Authority relating to corresponding PCT/US2013/000190 dated Nov. 21, 2013.

(Continued)

*Primary Examiner* — Brian W Cohen
(74) *Attorney, Agent, or Firm* — Gowling WLG (Canada) LLP; Damien Calvet

(57) ABSTRACT

A method of monitoring an electrolytic cell including detecting information indicative of a thermite reaction, comparing the information indicative of a thermite reaction to a threshold, generating a thermite response signal according to the comparison, and reacting to the thermite response signal by adjusting the operation of the electrolytic cell.

10 Claims, 27 Drawing Sheets

(56) References Cited

U.S. PATENT DOCUMENTS

| | | | | |
|---|---|---|---|---|
| 4,786,379 | A | 11/1988 | Barnett | |
| 4,921,584 | A | 5/1990 | Koski et al. | |
| 6,558,526 | B2 * | 5/2003 | D'Astolfo, Jr. | C25C 3/06 205/396 |
| 2004/0094409 | A1 | 5/2004 | D'Astolfo et al. | |
| 2005/0067298 | A1 | 3/2005 | DelClos et al. | |
| 2005/0173250 | A1 | 8/2005 | Thies et al. | |
| 2008/0067060 | A1 | 3/2008 | Burg et al. | |
| 2009/0236233 | A1 | 9/2009 | D'Astolfo, Jr. et al. | |

FOREIGN PATENT DOCUMENTS

| | | |
|---|---|---|
| JP | 2003160893 | 6/2003 |
| RU | 2113552 C1 | 6/1998 |

OTHER PUBLICATIONS

"Phase III Advanced Anodes and Cathodes Utilized in Energy Efficient Aluminum Production Cells", Final Technical Progress Report for Aug. 1998 through Jul. 2001; Nov. 5, 2001 Cooperative Agreement No. DE-FC07-981D13666 http://eelndom1.ee.doe.gov/OIT/oitpdf.nsf/Files/advancedanodes_cathodes.pdf/$file/advancedanodes_cathodes.pdf.

Chinese Search Report issued in Chinese Application No. 201380037291.5 (2016).

Supplementary European Search Report issued in European Application No. 13829637 (2016).

Russian Search Report issued in Russian Application No. 2015108749/02 (2016).

* cited by examiner

ΔZ=0.1348 m BETWEEN TWO SAMPLING POINTS
CELL RESISTANCE = 3.926 V/9350 A≈0.42 mΩ(8.7%)

SUMMARY TABLE

| | ANODE PIN CURRENT (A) | STUB VOLTAGE DROP (V) OVER 0.1348 m | | | | PLATE POTENTIAL VARIATION (V) | CELL RESISTANCE (mΩ) | CELL R CHANGE FROM NORMAL |
|---|---|---|---|---|---|---|---|---|
| | | STUB 1 & 2 | STUB 3 | STUB 4 | STUB 5 & 6 | | | |
| NORMAL | 213 | 0.0148 | 0.0195 | 0.0195 | 0.0162 | 0.011 | 0.460 | 0.00% |
| CASE 2 | 419 | 0.0145 | 0.0214 | 0.0191 | 0.0158 | 0.016 | 0.452 | −1.74% |
| CASE 3 | 868 | 0.0138 | 0.0254 | 0.0181 | 0.0150 | 0.034 | 0.432 | −6.09% |
| CASE 4 | 1162 | 0.0133 | 0.0281 | 0.0176 | 0.0145 | 0.046 | 0.420 | −8.70% |
| CASE 5 | 1429 | 0.0128 | 0.0305 | 0.0170 | 0.0140 | 0.046 | 0.408 | −11.30% |
| CASE 1 | 2909 | 0.0104 | 0.0440 | 0.0140 | 0.0113 | 0.0118 | 0.345 | −25.00% |

FIG. 22

SYSTEMS AND METHODS FOR PREVENTING THERMITE REACTIONS IN ELECTROLYTIC CELLS

CROSS-REFERENCE TO RELATED APPLICATIONS

This application is a continuation of U.S. patent application Ser. No. 13/987,650 filed on Aug. 19, 2013, which claims priority to U.S. Provisional Application No. 61/684,212 filed on Aug. 17, 2012, and U.S. Provisional Application No. 61/800,649, filed on Mar. 15, 2013. The disclosure of U.S. Provisional Applications Nos. 61/684,212 and 61/800,649 are hereby incorporated by reference in their entirety for all purposes.

COPYRIGHT NOTIFICATION

This application includes material which is subject to copyright protection. The copyright owner has no objection to the facsimile reproduction by anyone of the patent disclosure, as it appears in the Patent and Trademark Office files or records, but otherwise reserves all copyright rights whatsoever.

BACKGROUND OF THE INVENTION

1. Field of the Invention

The present invention relates to thermite reactions in electrolytic cells. More particularly, the present invention relates to systems and methods for the detection and/or prevention of thermite reactions in electrolytic cells.

2. Description of the Related Art

Electrolysis of alumina within an electrolytic cell is the major industrial process for the production of aluminum metal. In an aluminum electrolytic cell, an electrical current is passed between an anode and a cathode immersed within a bath of molten cryolite containing dissolved alumina. The electrical current causes the deposition of aluminum metal on the cathode. Commonly, the anodes are made of carbon or graphite materials. Carbon anodes are consumed during the aluminum production process, producing carbon dioxide, and must be replaced frequently.

In some electrolytic cells, the use of substantially "non-consumable" or "inert" anodes offer a cost effective and more environmentally sound alternative to carbon anodes. However, when the inert anode includes metal oxides, there is a possibility of a thermite reaction between the metal oxides and the aluminum metal in the electrolysis cell, leading to possible cell failure or cell eruption.

Thermite reactions are highly exothermic oxidation-reduction reaction which occurs—between metal oxides and another metal, such as aluminum, in the presence of heat.

For example, typical thermite reactions that can occur in an electrolytic cell are set out below as Equations 1 and 2.

$$M_xO_y\text{(metal oxide)}+2Y/3\ Al\text{(metal)}\rightarrow XM+Y/3Al_2O_3+\text{heat} \quad \text{(eq.1)}$$

$$Fe_2O_3\text{(iron oxide)}+2Al\text{(aluminum metal)}\rightarrow 2Fe+Al_2O_3+\text{heat} \quad \text{(eq.2)}$$

As illustrated in Equation 2, because aluminum forms stronger bonds with oxygen than iron, aluminum metal reduces iron oxide to produce aluminum oxide, iron, and large amounts of heat.

As in other electrolytic metal production processes, the electrolytic production of aluminum involves high heat within an electrolytic cell (e.g. temperatures of up to 950° C.) and the presence of metal (aluminum) to fuel a thermite reaction. Thus, under certain operating conditions, using inert anodes having metal oxides may cause a thermite reaction within the electrolytic cell.

SUMMARY OF THE INVENTION

The present invention relates to thermite reactions in electrolytic cells. More particularly, the present invention relates to systems and methods for the detection and/or prevention of thermite reactions in electrolytic cells. In some embodiments, the present invention provides methods of monitoring electrolytic cells for indicators of a thermite reaction.

Additional goals and advantages of the present invention will become more evident in the description of the figures, the detailed description of the invention, and the claims.

The foregoing and/or other aspects and utilities of the present invention may be achieved by providing a method of monitoring an electrolytic cell, including detecting information indicative of a thermite reaction, comparing the information indicative of a thermite reaction to a threshold, generating a thermite response signal according to the comparison, and reacting to the thermite response signal.

In another embodiment, the detecting information indicative of a thermite reaction includes detecting information indicative of a thermite reaction from one or more anodes, and wherein the one or more anodes comprise a metal oxide.

In another embodiment, the information indicative of a thermite reaction includes information related to an electrical current passing through the one or more anodes.

In another embodiment, the information indicative of a thermite reaction includes at least one of a magnetic field associated with the one or more anodes, an electrical field associated with the one or more anodes, and a voltage associated with the one or more anodes.

In another embodiment, the information indicative of a thermite reaction includes a voltage drop associated with the one or more anodes.

In another embodiment, the voltage drop is detected across known points in each of the one or more anodes.

In another embodiment, the voltage drop is detected cross known point in an anode distribution plate supporting a group of the one or more anodes.

In another embodiment, the voltage drop is detected cross known point in an anode assembly supporting the one or more anodes or one or more anode distribution plates.

In another embodiment, the voltage drop is detected across known points of at least each of the one or more anodes, an anode distribution plate supporting a group of the one or more anodes, and an anode assembly supporting the one or more anodes or one or more anode distribution plates.

In another embodiment, the comparing of the information indicative of a thermite reaction to a threshold includes comparing the voltage drop associated with the one or more anodes to a threshold voltage drop.

In another embodiment, the threshold voltage drop is based on past operational data of the electrolytic cell.

In another embodiment, the threshold voltage drop is a voltage drop level previously associated with a thermite reaction.

In another embodiment, the threshold voltage drop is a rate of voltage drop increase.

In another embodiment, the threshold voltage drop is a computer derived threshold derived from one of past operational data of the electrolytic cell or operation parameters and composition of the electrolytic cell.

In another embodiment, the generating of the thermite response signal according to the comparison includes generating the thermite response signal if the detected voltage drop matches or exceeds the threshold voltage drop.

In another embodiment, the generating of the thermite response signal according to the comparison includes generating the thermite response signal if the detected voltage drop indicates a sudden rise of voltage drop across the one or more anodes.

In another embodiment, the generating of the thermite response signal according to the comparison includes generating the thermite response signal if, when compared to the threshold, the detected voltage drop indicates a sudden rise of voltage drop across the one or more anodes.

In another embodiment, the generating of the thermite response signal according to the comparison includes generating a standby signal as the thermite response signal if the detected voltage drop does not match or exceed the threshold voltage drop.

In another embodiment, the generating of the thermite response signal according to the comparison includes generating a standby signal as the thermite response signal if, when compared to the threshold, the detected voltage drop does not indicate a sudden rise of voltage drop across the one or more anodes.

In another embodiment, the reacting to the thermite response signal includes continuing detecting information indicative of a thermite reaction when the thermite response signal is a standby signal.

In another embodiment, the reacting to the thermite response signal includes sending a signal to an operator of the electrolytic cell.

In another embodiment, the reacting to the thermite response signal includes adjusting operational parameters of the electrolytic cell.

In another embodiment, the adjusting the operational parameters of the electrolytic cell includes one or more of changing the ACD of the one or more anodes, moving the one or more anodes, removing the one or more anodes from an electrolytic bath, changing a current supplied to the one or more anodes, changing a temperature of the electrolytic bath, changing an electrolytic bath chemistry, removing the electrode assembly from the electrolytic bath, changing the electrical current supplied to the electrolytic cell.

In another embodiment, the magnitude of the thermite response signal corresponds to the magnitude of the detected voltage drop, and wherein the reacting to the thermite response signal is commensurate to the magnitude of the thermite response signal.

The foregoing and/or other aspects and utilities of the present invention may also be achieved by providing an inert anode electrolytic cell, including two or more groups of inert anodes configured to deliver an electric current to an electrolytic bath in liquid contact with the two or more anodes, a first anode distributor plate electrically connected to a first group of inert anodes configured to distribute the electrical current to the first group of inert anodes, a first voltage probe configured to detect a voltage drop associated with the first anode distributor plate and transmit a corresponding first voltage drop signal, a second anode distributor plate electrically connected to a second group of inert anodes configured to distribute the electrical current to the second group of inert anodes, a second voltage probe configured to detect a voltage drop associated with the second anode distributor plate and transmit a corresponding second voltage drop signal, a monitoring device configured to receive the first and second voltage drop signals and configured to generate a thermite response signal if one of the first or second voltage drop signal meets or exceeds a threshold voltage drop, and a pot control system configured to receive the thermite response signal and configured to adjust operation parameters of the electrolytic cell according to the thermite response signal, wherein the monitoring device generates the thermite response signal if, when compared to the threshold voltage drop, one or more of the first and second voltage drop signals voltage drop indicates a sudden rise of voltage drop across the first or second anode distributor plate.

The foregoing and/or other aspects and utilities of the present invention may also be achieved by providing an apparatus including a molten electrolyte bath, at least one cathode, in liquid communication with the bath, a plurality of inert anodes including a metal-oxide material, wherein the inert anodes are in liquid communication with the bath, and a monitoring device in communication with each anode of the plurality of anodes (e.g. through a voltage probe configured to measure a voltage drop between a point on the anode current supply and a common point on the electrical distribution plate or other structure), wherein the monitoring device is configured to receive a voltage drop signal associated with each anode (e.g. each anode's voltage probe), wherein the monitoring device compares the plurality of voltage drop signals from the plurality of anodes to a predetermined threshold, further wherein, the monitoring device generates a response signal indicative of a thermite reaction (e.g. whether a thermite reaction is present).

The foregoing and/or other aspects and utilities of the present invention may also be achieved by providing an apparatus including an electrode assembly having a first group of inert anodes, the anodes including a metal-oxide material; at least one distributor, wherein each anode of the first group of anodes is electrically connected to the distributor such that the distributor measures a voltage drop across a common current supply to the first group of anodes, wherein the distributor is adapted to generate a signal indicative of the total current passing through the first group of anodes; and a monitoring device in communication with the distributor, wherein the monitoring device is adapted to receive and compare the signal from the distributor to a predetermined threshold value (e.g. of voltage drop) and generates a response signal indicative of a thermite reaction in the anode assembly.

The foregoing and/or other aspects and utilities of the present invention may also be achieved by providing an apparatus including an electrode assembly including at least two distributors, including a first distributor and a second distributor; a first group of metal-oxide based anodes connected to the first distributor, wherein each anode of the first group of anodes is electrically connected to the first distributor, wherein the first distributor measures a voltage drop across a common current supply to the first group of anodes, wherein the first distributor is configured to generate a signal indicative of the total current passing through the first group of anodes; a second group of metal-oxide based anodes connected to the second distributor, wherein each anode of the second group of anodes is electrically connected to the second distributor, wherein the second distributor measures a voltage drop across a common current supply to the second group of anodes, wherein the second distributor is adapted to generate a signal indicative of the total current passing through the second group of anodes; a monitoring device in communication with the first distributor and second distributor, wherein the monitoring device is adapted to receive the signals from the distributors and generate a response signal indicative of a thermite reaction in the anode assembly.

The foregoing and/or other aspects and utilities of the present invention may also be achieved by providing a method including measuring a voltage drop across a common current supply to a plurality of metal-oxide based anodes; comparing the voltage drop to a predetermined threshold; and determining whether a thermite reaction is occurring.

The foregoing and/or other aspects and utilities of the present invention may also be achieved by providing a method including measuring the voltage drop across a common current supply to a plurality of anodes, wherein the anodes include a metal-oxide; directing a signal indicative of voltage drop from the anode to the monitoring device, comparing the signal to the predetermined threshold via the monitoring device, generating a response signal in accordance with the comparison result (e.g. to address whether there is a thermite reaction present in the cell/anodes); and adjusting the system or cell component in accordance with the response signal.

In some embodiments, one or more of the operations may be repeated, e.g. to continuously and/or intermittently monitor the anodes for a thermite reaction.

The foregoing and/or other aspects and utilities of the present invention may also be achieved by providing a method including providing a plurality of anode groups, where each anode group communicates with a distributor, wherein each anode group is adapted to connect (e.g. and electrically communicate) with the distributor; communicating a voltage drop signal from each anode of each anode group to each distributor for that anode group; communicating the greatest voltage drop signal collected at each distributor to a monitoring device; comparing the greatest voltage drop signal to the predetermined threshold via the monitoring device; and generating a response signal, via the monitoring device, indicative of whether there is a thermite reaction.

In some embodiments, the method includes adjusting the system or cell component (e.g. to prevent, reduce, and/or eliminate the thermite reaction).

In some embodiments, one or more of the method steps can be repeated.

In some embodiments, stub voltage drop (against normal conditions) is used to detect possible electrical short conditions.

In some embodiments, electrolytic cell resistance drop (against normal conditions) is used to detect electrical short conditions.

In some embodiments, plate resistance drop (against normal conditions) is used to detect electrical short conditions In some embodiments, the signal is proportional to the current in any distributor plate.

In some embodiments, one or more of the instant systems and/or methods measure and prevent anode degradation (e.g. through thermite reactions occurring on the anode). In one or more embodiments, the instant systems and/or methods control exothermic reactions within the electrolytic cell. In one or more embodiments of the present invention, inert anodes having metal oxides are used to make primary metals via an electrolytic cell, while ensuring that the inert anodes and/or electrolytic cell do not fail due to thermite reactions.

BRIEF DESCRIPTION OF THE DRAWINGS

These and/or other aspects and advantages of the present invention will become apparent and more readily appreciated from the following description of the various embodiments, taken in conjunction with the accompanying drawings of which:

FIGS. 10-27 illustrate a computer model simulating embodiments of the present invention.

Figure 1A:
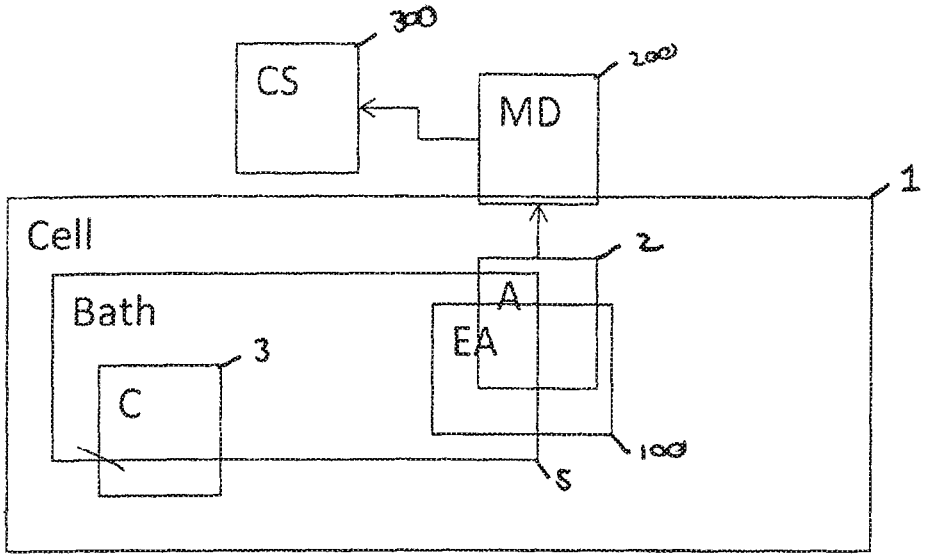
FIGS. 1A and 1B illustrate electrolytic cell schematics according to embodiments of the present invention.

The drawings referenced above are not necessarily to scale, with emphasis instead generally being placed upon illustrating the principles of the present invention. Further, some features may be exaggerated to show details of particular components. These drawings/figures are intended to be explanatory and not restrictive of the invention.

DETAILED DESCRIPTION OF THE EMBODIMENTS

Reference will now be made in detail to the various embodiments of the present invention. The embodiments are described below to provide a more complete understanding of the components, processes and apparatuses of the present invention. Any examples given are intended to be illustrative, and not restrictive. Throughout the specification and claims, the following terms take the meanings explicitly associated herein, unless the context clearly dictates otherwise. The phrases "in some embodiments" and "in an embodiment" as used herein do not necessarily refer to the same embodiment(s), though they may. Furthermore, the phrases "in another embodiment" and "in some other embodiments" as used herein do not necessarily refer to a different embodiment, although they may. As described below, various embodiments of the present invention may be readily combined, without departing from the scope or spirit of the present invention.

As used herein, the term "or" is an inclusive operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

All physical properties that are defined hereinafter are measured at 20° to 25° Celsius unless otherwise specified.

When referring to any numerical range of values herein, such ranges are understood to include each and every number and/or fraction between the stated range minimum and maximum. For example, a range of about 0.5-6% would expressly include all intermediate values of about 0.6%, 0.7%, and 0.9%, all the way up to and including 5.95%, 5.97%, and 5.99%. The same applies to each other numerical property and/or elemental range set forth herein, unless the context clearly dictates otherwise.

As used herein, "electrode" may refer to positively charged electrodes (e.g. anodes) and negatively charged electrodes (e.g. cathodes).

As used herein, "inert anode" refers to an anode which is not substantially consumed or is substantially dimensionally stable during the electrolytic process. Some non-limiting examples of inert anodes include: ceramic, cermet, metal (metallic) anodes, and combinations thereof.

As used herein, "voltage drop" refers to a voltage difference between two objects or two points on the same object.

In some embodiments of the present invention, metal oxide refers to a metallic component of an anode which is oxidized during electrolysis. In other embodiments, the metal oxide is formed as a layer or portion on the inert anode during electrolysis.

In some embodiments, the anodes are constructed of an electrically conductive material, including but not limited to: metals, metal oxides, ceramics, cermets, carbon, and combinations thereof. In one non-limiting example, the anodes are constructed of mixed metal oxides, including iron oxides, as described in U.S. Pat. No. 7,507,322 or U.S. Pat. No. 7,235,161 (e.g. FeO, FeO2, and Fe2O3, and combinations thereof).

FIGS. 1A-1B and 2-3 illustrate electrolytic cell schematics according to embodiments of the present invention. As illustrated in FIGS. 1A-1B and 2-3, an electrolytic cell (1) may include an anode (2), a cathode (3), an electrode assembly (100), an electrolytic bath (5), and a monitoring device (200). The electrolytic cell (1) may be controlled via a pot control system (300).

In one embodiment of the present invention, the anode (2) and the cathode (3) are immersed in the electrolytic bath (5). In another embodiment, the anode (2) communicates with the monitoring device (200), and the monitoring device (200) in turn communicates with the pot control system (300). In one embodiment, the anode (2) communicates with monitoring device (200) via anode proves (500) (not illustrated). In one embodiment, the anode probes (500) are embodied as anode voltage probes (500).

Figure 1B:
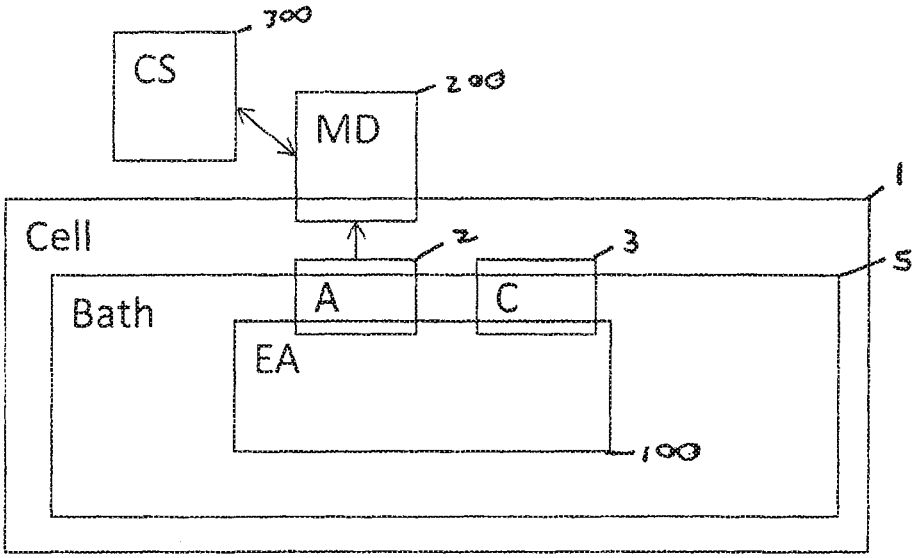

As illustrated in FIG. 1A, in one embodiment, the anode (2) is disposed on the electrode assembly (100). In another embodiment, as illustrated in FIG. 1B, both the anode (2) and cathode (3) are disposed on the electrode assembly (100).

Figure 2:
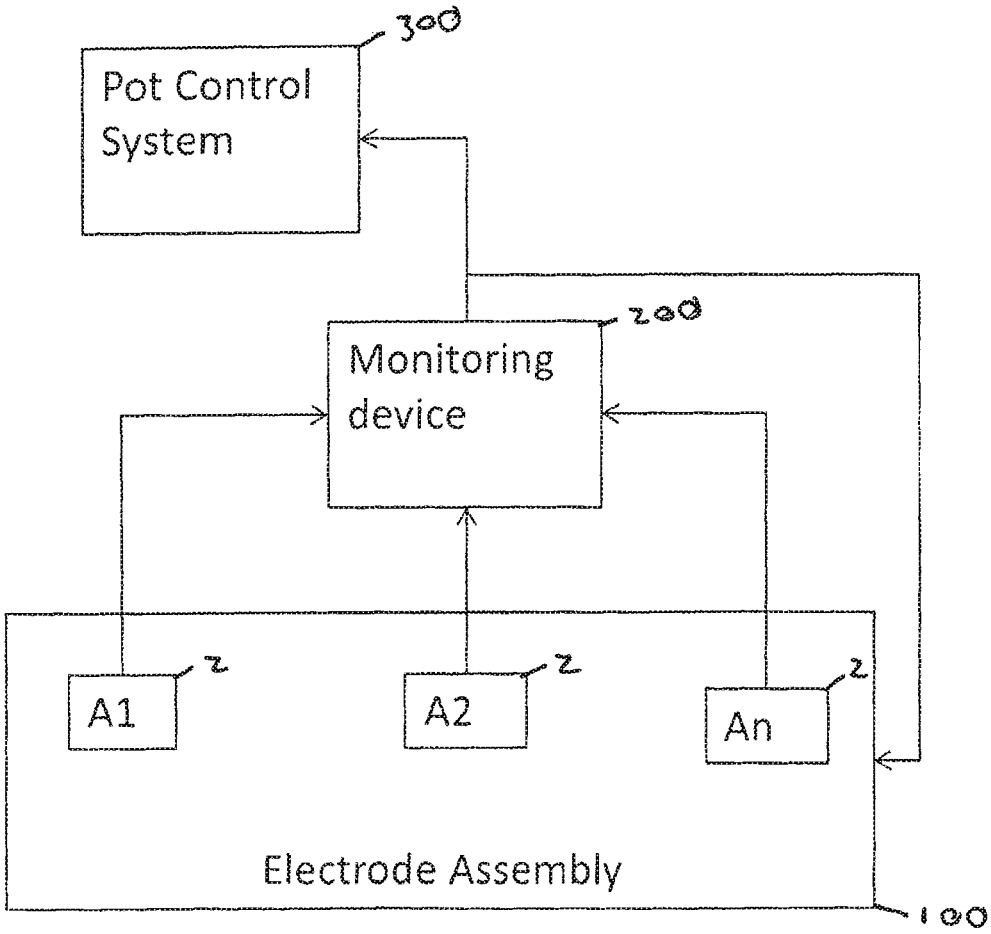
FIGS. 2 and 3 illustrate anode assemblies according to embodiments of the present invention.

As illustrated in FIG. 2, in an embodiment of the present invention, the electrolytic cell (1) includes a plurality of anodes (2) ($A_1, A_2 \ldots A_n$). In one embodiment, each anode (2) ($A_1, A_2 \ldots A_n$) is equipped with a voltage probe (500), which measures and communicates a voltage drop signal from each anode (2) ($A_1, A_2 \ldots A_n$) to the monitoring device (200).

Figure 3:
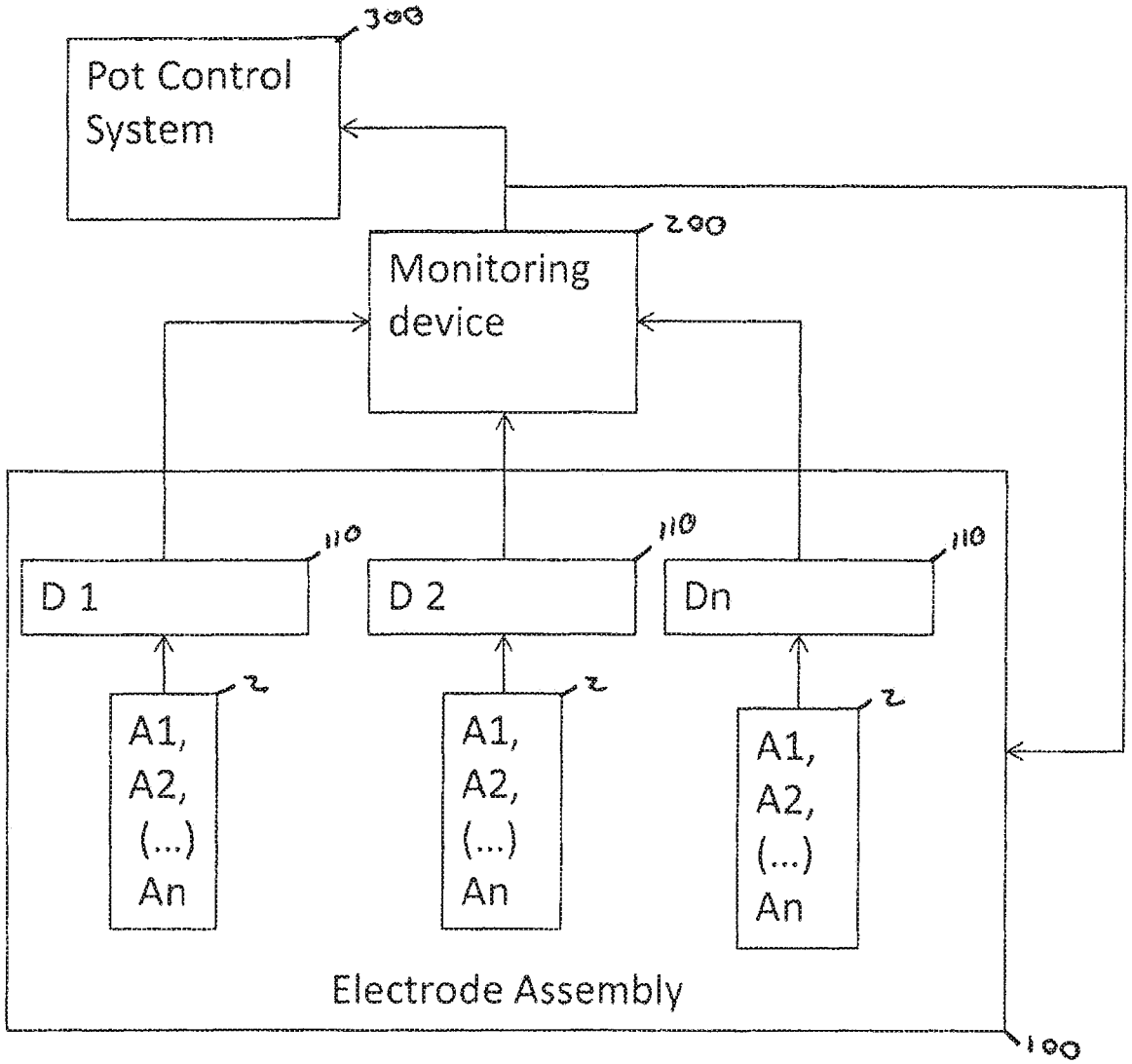

As illustrated in FIG. 3, in another embodiment, the electrolytic cell (1) includes a plurality of anodes (2) ($A_1, A_2 \ldots A_n$) and a plurality of anode distribution plates (110) ($D_1, D_2 \ldots D_n$). In one embodiment, separate groups of the anodes (2) ($A_1, A_2 \ldots A_n$) are separately supported by each of the anode distribution plates (110) ($D_1, D_2 \ldots D_n$).

In one embodiment, each anode (2) is equipped with an anode voltage probe (500). In some embodiment, the anode voltage probes (500) are equipped with a sensor or filter configured to transmit only the highest voltage drop signal to each distributor plate (110) and/or monitoring device (200). In other embodiments, all voltage drop signals are transmitted from the anode voltage probes (500) to each anode distribution plate (110) and/or monitoring device (200).

In another embodiment, each anode distribution plate (110) is equipped with an anode distribution plate voltage probe (500) configured to measure and communicate a voltage drop signal from each anode distribution plate (110) to the monitoring device (200).

In some embodiment, the anode distribution plate voltage probe (500) are equipped with a sensor or filter configured to transmit only the highest voltage drop signal to the monitoring device (200). In other embodiments, all voltage drop signals are transmitted from the anode distribution plate voltage probe (500) to the monitoring device (200).

In one embodiment of the present invention, the voltage probe (500) includes one or more measuring points configured to measure a voltage drop between said points and the voltage probe (500) is configured to transmit a voltage drop signal corresponding to the measured voltage drop. For example, in one embodiment, the voltage probes (500) are configured to measure a voltage drop between two points on an anode (2). In some embodiments, the voltage drop signal includes a magnitude or value associated with the size of the voltage drop.

In one embodiment, a current imbalance due to a thermite reaction or electrical shorting within the electrolytic cell (1) will affect a voltage drop within one or more of the anodes (2). In some embodiments, the measured voltage drop will indicate an approximate location of the issue. In other embodiments, the measured voltage drop will indicate the exact anode (2) or group of anodes (2) affected.

In another embodiment, the voltage probe (500) are disposed to measure a voltage drop between a top of each anode conductor (299) to a common point on each anode (2), such as the anode rod (2*a*). While this embodiment may require more signals and wire attachment sites, it may provide a more sensitive detection of current imbalances, as well as pinpointing the exact location of the current imbalance.

In another embodiment, the voltage probes (500) are configured to measure a voltage drop between a point on the anode current supply and a common point on the electrical distribution plate (110) or other electrically connected structure.

Figure 7:
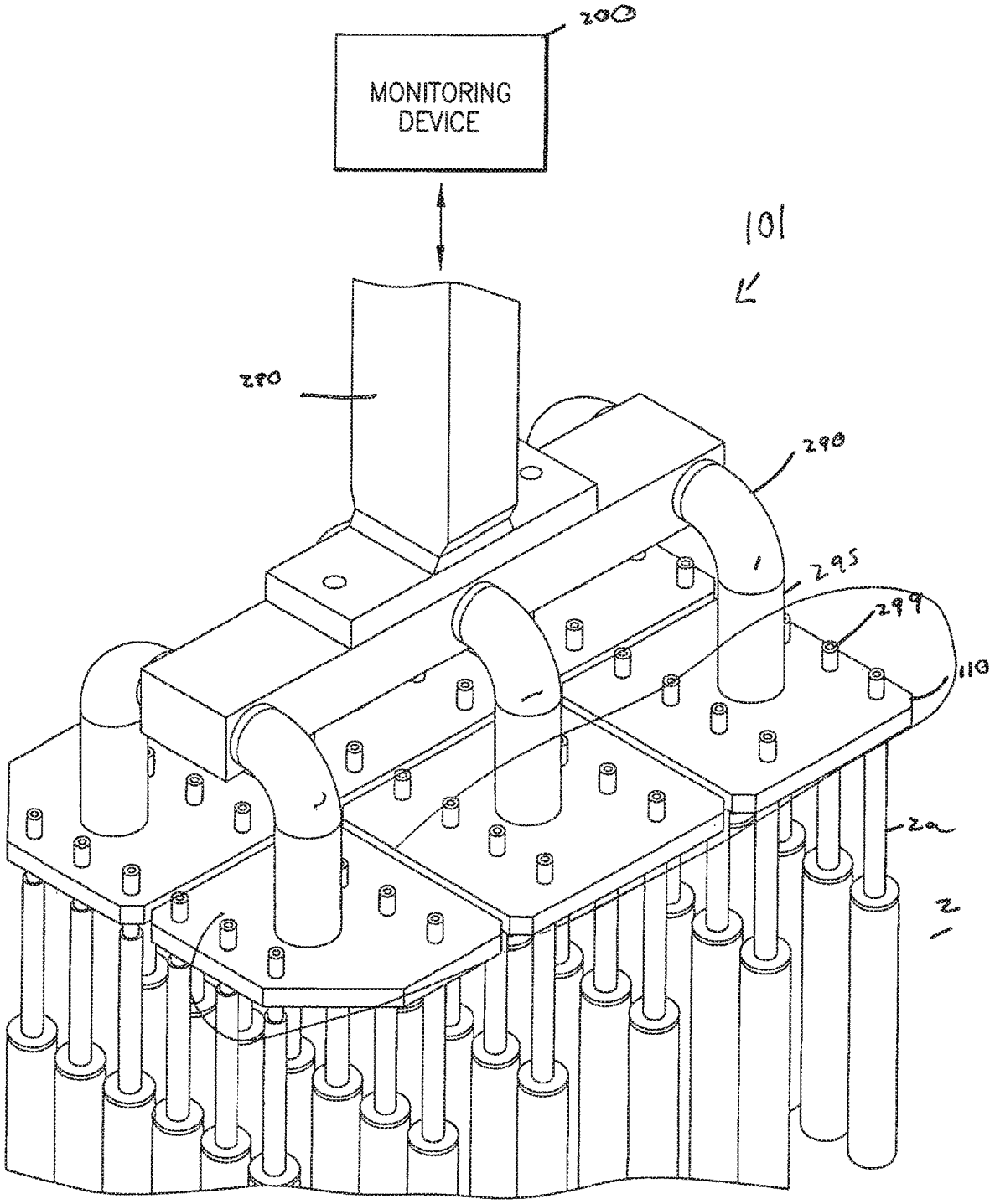
FIGS. 7 and 8 illustrate anode assemblies according to embodiments of the present invention.
Figure 8:
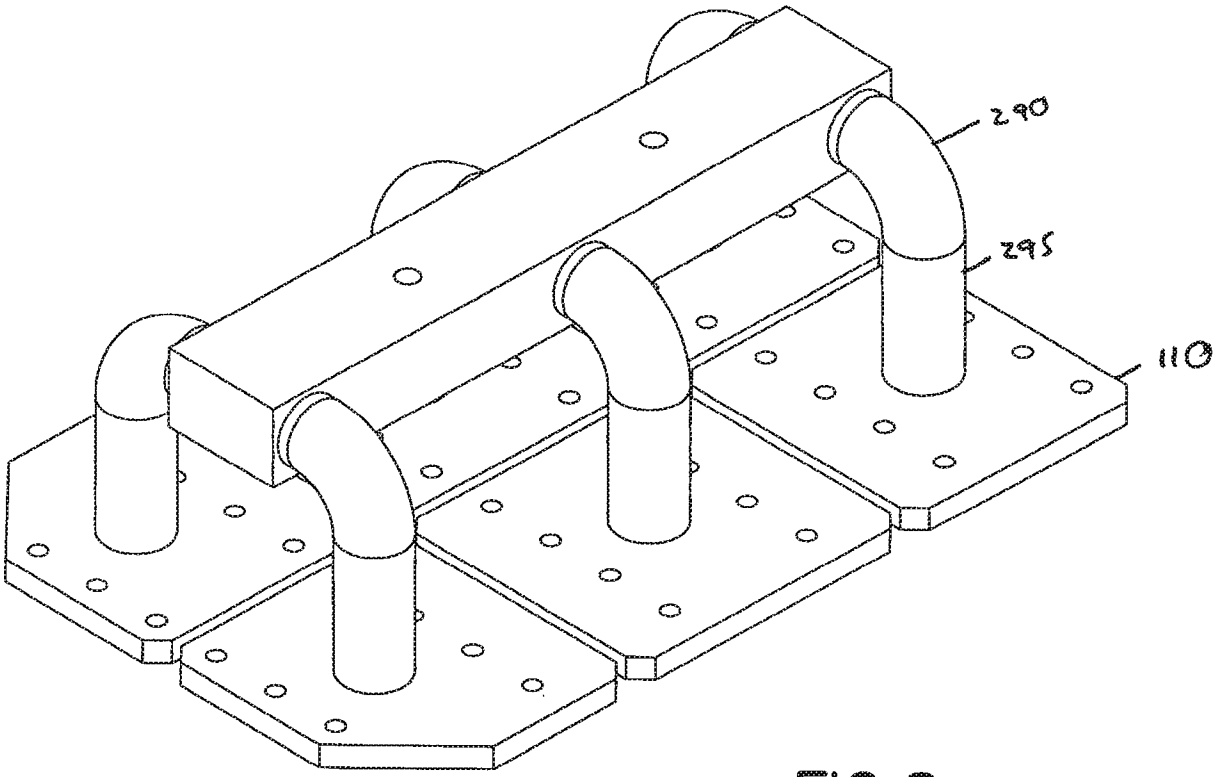

As illustrated in FIGS. 7-8, in other embodiments, the electrolytic cell (1) includes one or more anode assemblies (101) as the electrode assembly (100). In some embodiments, each anode assembly (101) may include one or more groups of the anodes (2) ($A_1, A_2 \ldots A_n$). In other embodiments, each groups of the anodes (2) ($A_1, A_2 \ldots A_n$) is supported by an anode distribution plate (110).

In some embodiments, the voltage probes (500) are attached to the anode assembly (101) at one or more locations to measure an associated voltage drop. For example In some embodiments, the voltage probes (500) are configured to measure a voltage drop of the anode assembly (101). In other embodiments, the voltage probes (500) are configured to measure a voltage drop of each anode distribution plate (110).

In some embodiments, because a group of anodes (2) may be electrically connected through an anode distribution plate (110), a voltage drop indicative of a thermite reaction in one or more anodes (2) will cause a current imbalance across the anode distribution plate (110) affecting a voltage drop of the anode distribution plate (110). For example, when a thermite reaction or electrical shorting affects the electrical current within one or more of the anodes (2), a measured voltage drop across the anode distribution plate (110) will be affected. In some embodiments, the measured voltage drop of the anode distribution plates (110) will indicate an approximate location of the issue. That is, which anode distribution plate (110) may have an anode (2) potentially subject to a thermite reaction or electrical short.

For example, and in reference to FIGS. 7-8, in some embodiments, electrical current travels down an anode electrical connection (280), through a current supply (290), and a current supply stub (295) into an anode distributor plate (110). The distributor plate (110) distributes the electrical current to a group of anodes (2) electrically connected to the distributor plate (110) via each anode conductor or anode pin attachment site (299). In some embodiments, voltage probes (500) are provided along one or more of the current supply (290), current supply stub (295), anode distributor plate (110), anode conductor or anode pin attachment site (299), and anodes (2) to measure the voltage drop across particular regions of the anode assembly (101).

In some embodiments, under normal operating conditions, each anode (2) passes an identical current, or similar current within a range, when provided with a same electrical current. Accordingly, voltage drops measured in one or more regions of the anode assembly (101) (That is, at the current supply (290), current supply stub (295), anode distributor plate (110), anode conductor or anode pin attachment site (299), and anodes (2)) should be similar. If a thermite reaction causes a localized change in the electrical current passing through an anode (2), then a voltage drop measured at affected regions of the anode assembly (101) will also change and the change in voltage drop will serve as an indicator of a thermite reaction in that region.

Various methods of connecting the voltage probes (500) are envisioned. For example, in some embodiments, a hole is drilled/machined into the anode assembly (101) or anode distribution plate (110), with the hole then filled (e.g. with insulating material). In other embodiments, the probe is mechanically connected (i.e. directly to) to an outer portion of the anode assembly (101), anode distributor plate (110), anode electrical connection (280), anode electrical supply stub (290), etc.

Figure 9:
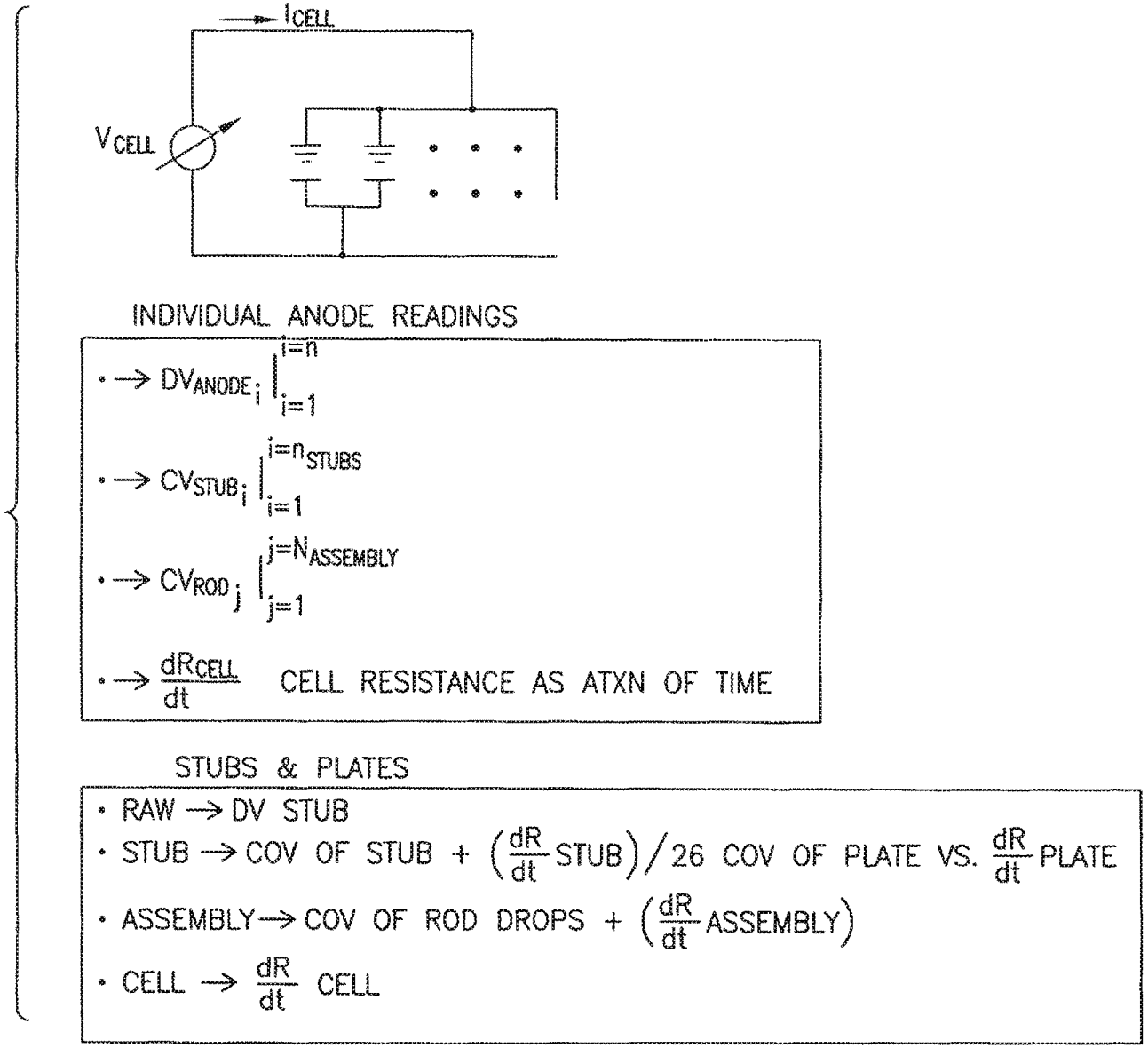
FIG. 9 illustrates various feedback signals which can be used in accordance with one or more of the embodiments of the present invention.

FIG. 9 illustrates various feedback signals which can be used in accordance with one or more of the embodiments of the present invention. As illustrated in FIG. 9, voltage drop measurements indicative of a thermite reaction can be measured at the level of individual anodes (2), anode distribution plates (110), and/or current supply stubs (295).

In one embodiment of the present invention, the monitoring device (200) receives the voltage drop signals from the anode voltage probes (500) and/or anode distribution plate voltage probes (500) and compares the voltage drop signals to a voltage drop threshold. In some embodiments, the monitoring device (200) generates a thermite response signal to indicate the possibility of a thermite reaction according to the comparison of the voltage drop signals to the voltage drop threshold.

In some embodiments of the present invention, operation parameters of the electrolytic cell (1) are controlled by a pot control system (300). In one embodiment, the pot control system (300) is configured to receive and react to a thermite response signal generated by the monitoring device (200). For example, in some embodiments, the pot control system (300) will effectuate changes in the operation of the electrolytic cell designed to avoid or suppress a thermite reaction, such as removal of the anodes (2) from the electrolytic bath (5), changing the voltage supplied to the anodes (2) or distribution plates (110), etc. In some embodiments, when a thermite response signal is not generated or when a standby signal is generated instead, the pot control system (300) assumes no change/adjustment is needed to avoid or suppress a thermite reaction.

Figure 4:
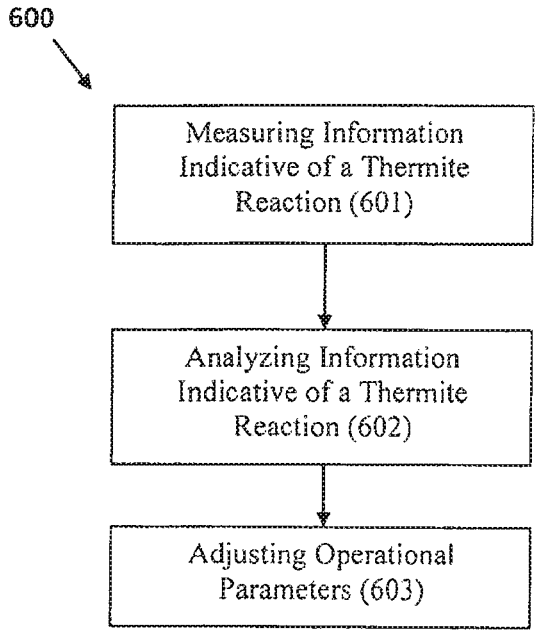
FIGS. 4, 5, and 6 illustrate methods of monitoring an electrolytic cell according to embodiments of the present invention.
Figure 5:
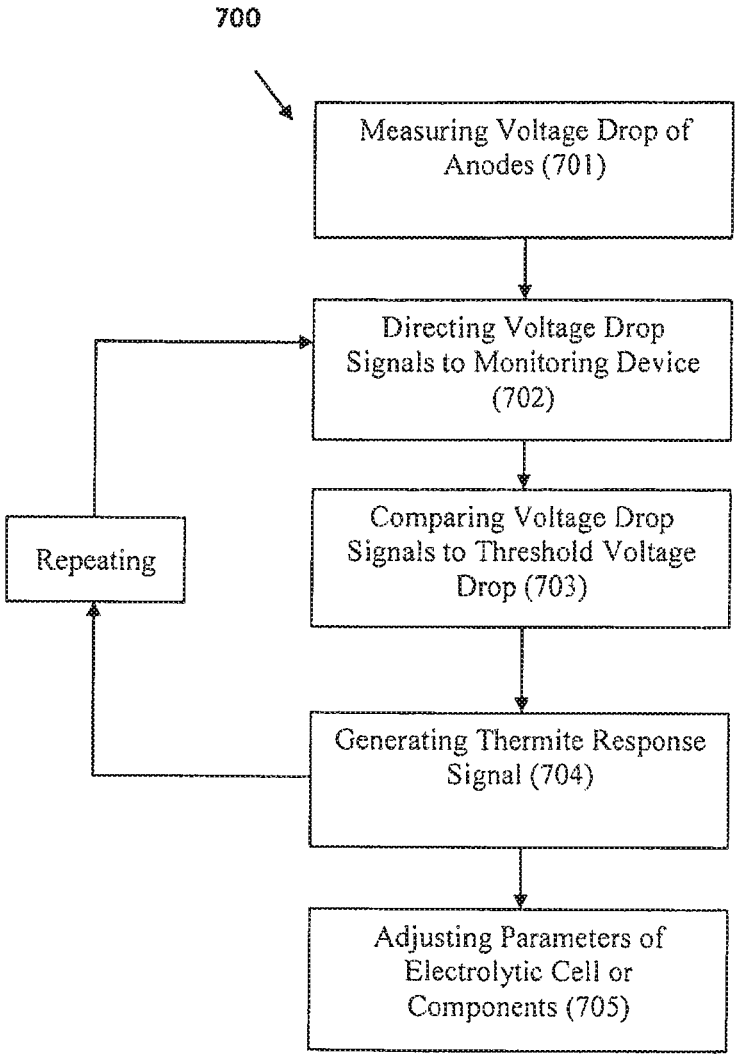
Figure 6:
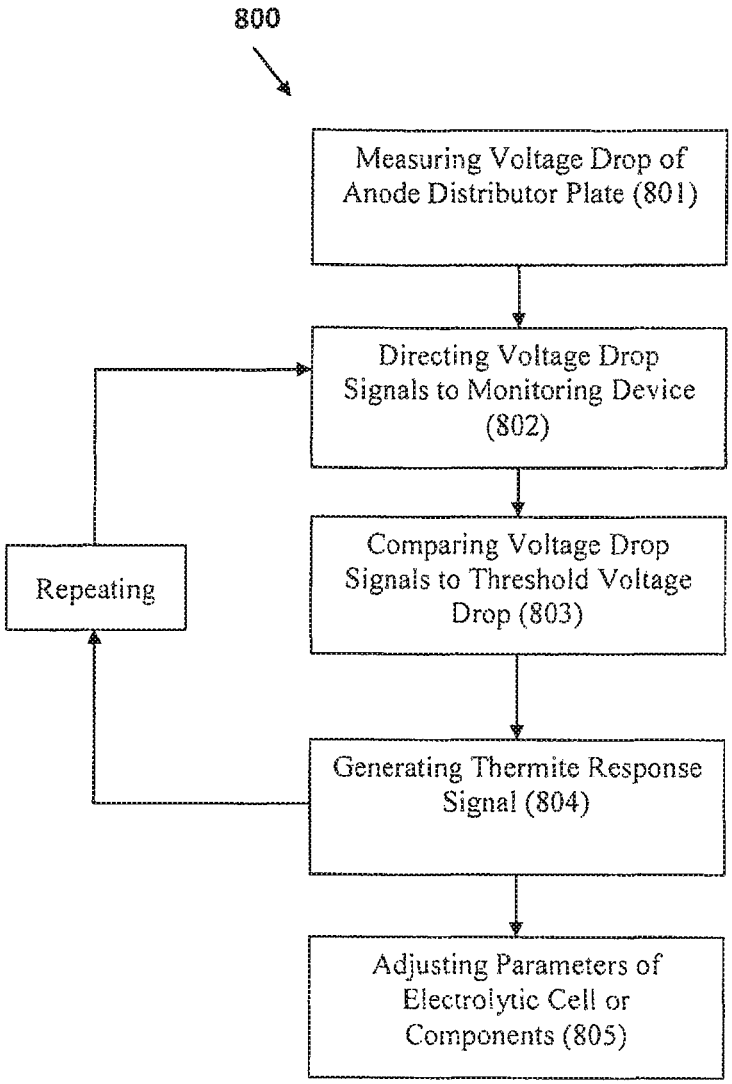

FIGS. 4, 5, and 6 illustrate methods of monitoring an electrolytic cell according to embodiments of the present invention.

As illustrated in FIG. 4, a method of monitoring an electrolytic cell may include measuring information indicative of a potential thermite reaction (601), analyzing the information indicative of a potential thermite reaction (602); and adjusting operational parameters of the electrolytic cell (603).

In an embodiment of the present invention, measuring information indicative of a potential thermite reaction in operation (601) includes measuring a voltage drop across one or more of anodes (2) of an electrolytic cell (1). In one embodiment, a voltage drop across each anode (2) is measured. In another embodiment, a voltage drop across a group of anodes is measured. For example, in one embodiment, a voltage drop may be measured from a distributor plate (110) supporting a group of the anodes ($A_1$, $A_2$ . . . $A_n$).

While some embodiments of the present invention rely on a measurement of a voltage drop across one or more anodes as information indicative of a thermite reaction and/or to generate a thermite response signal, the present invention is not limited thereto. In other embodiment, other information indicative of a thermite reaction may be measured and used to generate a thermite response signal. For example, to the extent that a change in the electrical current passing through an anode (2) or a distributor plate (110) indicates the possibility of a thermite reaction, in some embodiments, measuring information indicative of a potential thermite reaction in operation (601) includes measuring an electrical current passing through the one or more anodes (2) or distributor plates (110). In other embodiments, measuring information indicative of a potential thermite reaction in operation (601) includes measuring a magnetic field associated with the one or more anodes (2) or distributor plates (110). In yet other embodiments, measuring information indicative of a potential thermite reaction in operation (601) includes measuring an electrical field associated with the one or more anodes (2) or distributor plates (110). In some embodiments, the information indicative of a potential thermite reaction corresponds to at least one of a voltage, voltage drop, current, electrical field, and magnetic field associated with the one or more anodes (2) or distributor plates (110).

In one embodiment of the present invention, analyzing the information indicative of a potential thermite reaction (602) includes receiving the voltage drop signal from the electrolytic cell (1) anodes (2); and comparing the voltage drop signal to a voltage drop threshold to generate a thermite response signal.

In one embodiment, each anode (2) has a voltage probe (500) associated therewith to measure a voltage drop between two known points, and each voltage probe (500) is configured to send a voltage drop signal corresponding to the measured voltage drop of each anode (2) to a monitoring device (200). In another embodiment, each anode distribution plate (110) has a voltage probe (500) associated therewith to measure a voltage drop between two known points, and each voltage probe (500) is configured to send a voltage drop signal corresponding to the measured voltage drop of the anode distribution plate (110) to a monitoring device (200). In another embodiment, each anode assembly (101)

has a voltage probe (500) associated therewith to measure a voltage drop between two known points, and each voltage probe (500) is configured to send a voltage drop signal corresponding to the measured voltage drop of the anode assembly (101) to a monitoring device (200).

In an embodiment of the present invention, the monitoring device (200) receives the voltage drop signal and compares it to a predetermined voltage drop threshold. In one embodiment, if the voltage drop signal matches or exceeds the voltage drop threshold, the monitoring device (200) generates a thermite response signal. In another embodiment, if the voltage drop signal does not match or exceed the voltage drop threshold, the monitoring device (200) does not generate a thermite response signal or instead generates a standby signal. For example, in one embodiment, the monitoring device (200) receives a voltage drop signal from the anode distribution plate (110) and generates a thermite response signal if the voltage drop signal matches or exceeds the voltage drop threshold.

In some embodiments of the present invention, the thermite response signal varies according to a magnitude or size of the voltage drop signal. For example, larger voltage drop signals indicative of a greater likelihood of an electrical short or thermite reaction generate a larger thermite response signal in the monitoring device (200).

In an embodiment of the present invention, the voltage drop threshold refers to a predetermined voltage drop or voltage drop range indicative of a thermite reaction corresponding to the location and disposition of the voltage probes (500). As non-limiting examples, the predetermined voltage drop threshold value may include a range of acceptable voltage drop signals; an upper range for a voltage drop signal; an average voltage drop signal; a rate of change in voltage drop signal, a rate of voltage drop increase or decrease, and a combination thereof.

In one embodiment, the voltage drop threshold is calculated from, and is a function of, one or more of the electrolytic cell characteristics, electrolytic bath chemistry, operational parameters; reactant feed rates, anode or cathode composition, voltage or current supplied to the electrolytic cell or anodes, the anode to cathode distance ("ACD"), or a combination thereof. In one embodiment, the predetermined voltage drop threshold is based on a computer-generated probability of the anodes (2) undergoing a thermite reaction based upon one or more of the aforementioned variables.

In another embodiment, the voltage drop threshold is determined from previous operation of the electrolytic cell. For example, in one embodiment, a log is kept of voltage drop signals collected from past electrolytic runs for each electrolytic cell (1), and voltage drops corresponding to thermite reactions and/or electrical shorts are recorded for each run.

As used herein, in some embodiments a "monitoring device" refers to a device (or arrangement) for observing, detecting, and/or recording the operation of a component or system. For example, in some embodiments the monitoring device includes an automatic control system or computer configured to continually monitor, record, and compare the voltage drop signals to the voltage drop threshold and generates a thermite response signal.

In one embodiment of the present invention, adjusting the operational parameters of the electrolytic cell in operation (603) includes receiving a signal from the monitoring device (200) and adjusting operational parameters of the electrolytic cell (1) if required. For example, in one embodiment, the voltage drop signal received by the monitoring device (200) does not meet or exceed the pre-established voltage drop threshold. In that embodiment, the thermite response signal is not generated, and no thermite response signal is sent to the pot control system (300). The pot control system (300) then assumes that no changes/adjustments are needed to avoid or suppress a thermite reaction and just continues to monitor the monitoring device (200) for a thermite response signal. In another embodiment, if the voltage drop signal received by the monitoring device (200) does not meet or exceed the pre-established voltage drop threshold, the monitoring device (200) generates a standby signal. In that embodiment, the standby signal is sent to the pot control system (300) and the pot control system (300) assumes that no changes/adjustment are needed to avoid or suppress a thermite reaction and just continues to monitor the monitoring device (200) for a thermite response signal.

In other examples, if the voltage drop signal received by the monitoring device (200) meets or exceeds the pre-established voltage drop threshold, the monitoring device (200) generates a thermite response signal and sends it to the pot control system (300).

In other embodiments, the thermite response signal causes the pot control system (300) to effect a change in the electrode assembly (101), such as changing the ACD, moving the anodes (2), removing the anodes (2) from the electrolytic bath, changing the current or voltage supplied to the anodes (2), the anode plate (110), or the anode assembly (101), or combinations thereof. Non-limiting examples of adjustments to the electrolytic cell (1) include moving the anodes (2) up or down, changing the electrolytic bath temperature (e.g. increasing or decreasing the electrolytic bath temperature via moving an electrolytic cell cover); changing the electrolytic bath chemistry (e.g. increasing the electrolytic bath component ratio, changing the content of certain electrolytic bath constituents/components, or changing the amount of $Al_2O_3$ present in the electrolytic bath); changing the anode to cathode distance ("ACD") (e.g. increasing the distance or decreasing the distance); removing the electrode assembly (101) and/or anodes (2) from the electrolytic bath; changing the electrical current supplied to the electrolytic cell (1) (e.g. increasing or decreasing the current); and combinations thereof.

In one embodiment, the pot control system (300) effectuates changes configured to prevent or suppress thermite reaction associated with the inert anodes. In other embodiments, the pot control system (300) effectuates changes configured to reduce the occurrence of a thermite reaction associated with the inert anodes.

In some embodiments, the changes effectuated by the pot control system (300) are commensurate with the magnitude of the voltage drop. For example, in one embodiment, a greater rate of voltage drop increase, or a greater magnitude of the measured voltage drop, will cause the monitoring device (200) to generate a thermite response signal of a corresponding greater magnitude. In that embodiment, the changes effectuated by the pot control system (300) may include more changes or more severe changes to the operational parameters of the electrolytic cell (1) to address, prevent, or suppress a thermite reaction associated with the inert anodes.

FIG. 5 illustrates a method of monitoring an electrolytic cell according to another embodiment of the present invention.

As illustrated in FIG. 5, a method of monitoring an electrolytic cell (700) may include measuring a voltage drop of the anodes (701); directing the measured voltage drop signals to a monitoring device (702); comparing the measured voltage drop signals to a predetermined voltage drop threshold (703); generating a thermite response signal (704); and adjusting the electrolytic cell system or components thereof in accordance with the thermite response signal (705).

In one embodiment of the present invention, one or more of the operations of the method of monitoring an electrolytic cell (700) can be repeated, as necessary, to ensure that the anodes (2) in an electrolytic cell (1) are monitored appropriately for thermite reactions and/or to reduce the possibility of a thermite reaction occurring in the anodes during operation. As a non-limiting example, after generating a threshold response signal in operation (704); the method (700) can repeat back to the directing of the measured voltage drop signals to the monitoring device in operation (702), to determine whether the possibility of a thermite reaction has increased, decreased, or remains the same (e.g. no presence or probability of a thermite reaction).

FIG. 6 illustrates a method of monitoring an electrolytic cell according to another embodiment of the present invention.

As illustrated in FIG. 6, a method of monitoring an electrolytic cell (800) may include measuring a voltage drop of an anode distributor plate associated with a group of anodes (801); directing the measured voltage drop signals to a monitoring device (802); comparing the measured voltage drop signals to a predetermined voltage drop threshold (803); generating a threshold response signal (804); and adjusting the electrolytic cell system or components thereof in accordance with the thermite response signal (805).

In one embodiment of the present invention, one or more of the operations of the method of monitoring an electrolytic cell (800) can be repeated, as necessary, to ensure that the anode distribution plates (110) of an electrolytic cell (1) are monitored appropriately for thermite reactions and/or to reduce the possibility of a thermite reaction occurring in the anodes associated with each of the anode distribution plates (110). As a non-limiting example, after generating a threshold response signal in operation (804); the method (800) can repeat back to the directing of the measured voltage drop signals to the monitoring device in operation (802), to determine whether the possibility of a thermite reaction has increased, decreased, or remains the same (e.g. no presence or probability of a thermite reaction).

Example 1

In one example of the present invention, and referring to FIGS. 7-8, each individual anode (2) of an anode assembly (101) is electrically connected to a feedback device (monitoring device (200)) via a voltage sensor (voltage probe (500)).

Each voltage probes (500) attaches to the conductor pin (299) and another portion of the anode (2), such as the anode rod (2*a*), the anode body, or to another mechanical attachment device (e.g. clamps, etc, which do not include the conductor pin (299)).

The voltage drop measured by each voltage probe (500) indicates an amount of electrical current flowing to/through each anode (2). If a particular anode (2) starts a thermite reaction, the voltage drop signal for that anode (2) will rise rapidly in response to the increase in electrical current passing through that anode.

The monitoring device (200) receives the voltage drop signals from the anodes, and if it determines that a measured voltage drop signal matches or exceeds a predetermined voltage drop threshold it generates and forwards a thermite response signal to the pot control system (300) to adjust the operation conditions of the electrolytic cell (1) or its components to address the thermite reaction. For example by displaying a thermite warning signal to an operator, removing the anode (2) from the electrolytic bath, increasing the ACD, reducing the voltage of the system, etc.

Example 2

In another example of the present invention, and referring to FIGS. 7-8, each anode distributor plate (110) supports a separate group of anodes (2). Each anode distributor plate (110) is electrically connected to a monitoring device (200) via a voltage probe 500. In some embodiments, each anode distributor plate (110) is electrically isolated from each other. For example, in some embodiments, there is electrical insulation (e.g. air gap, electrical insulation) between the anode distributor plates (110). As non-limiting examples, the anode distributor plate (110) may be located above a thermal insulation layer of the electrode assembly (101) (e.g. without a coating) or below the thermal insulation layer of the electrode assembly (101) (e.g. with a protective coating).

Each voltage probes (500) measures the voltage drop associated with each anode distributor plate (110). The voltage drop measured by each voltage probe (500) indicates a total amount of electrical current flowing to/through all the anodes (2) supported by each anode distributor plate (110).

The monitoring device (200) receives the voltage drop signals from the anode distributor plates (110), and if it determines that a measured voltage drop signal matches or exceeds a predetermined voltage drop threshold it generates and forwards a thermite response signal to the pot control system (300) to adjust the operation conditions of the electrolytic cell (1) or its components to address the thermite reaction.

FIGS. 10-26 illustrate a computer model simulating embodiments of the present invention. In particular, these figures illustrate a computer model of an anode short during steady operation where electrolytic cell current was kept constant. An anode (anode X) was selected to draw an additional amount of current in a short period of time (while cell temperature was maintained). The computer model focused on the resulting impact on the plate electrical potential, sub (current supply) voltage drop, cell voltage, and cell resistance changes.

Figure 10:
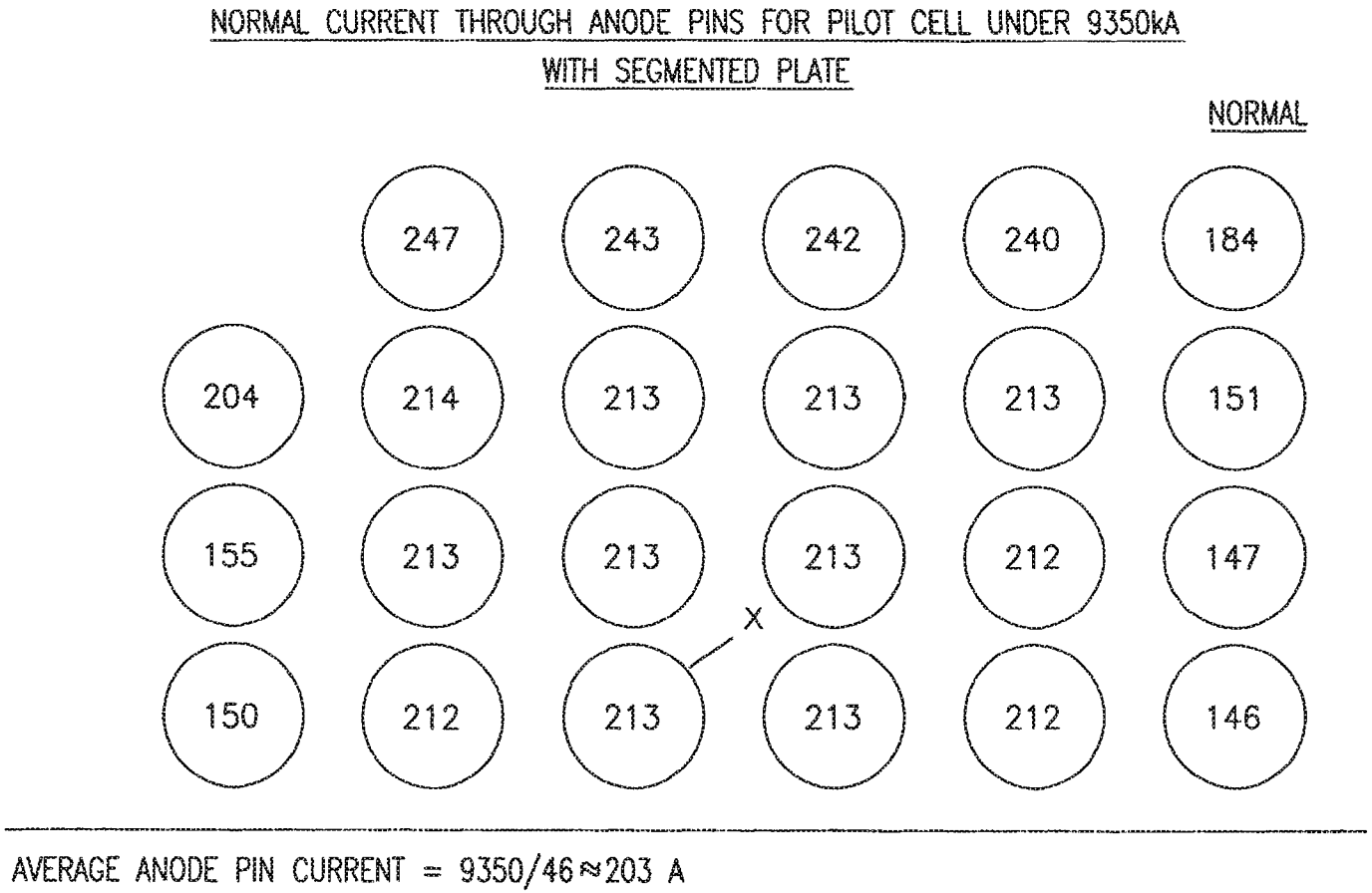

With reference to FIGS. 7-8, FIG. 10 illustrates a distribution of electrical current passing through anodes (2) in an electrode assembly (101). As illustrated in FIG. 10, under normal electrolytic cell operating conditions, the average electrical current through the anode pin attachment sites (299) is 203 amperes (A). In particular, as illustrated in FIG. 10, under normal operation conditions, anode "X" has an electrical current of 213 A.

Figure 11:
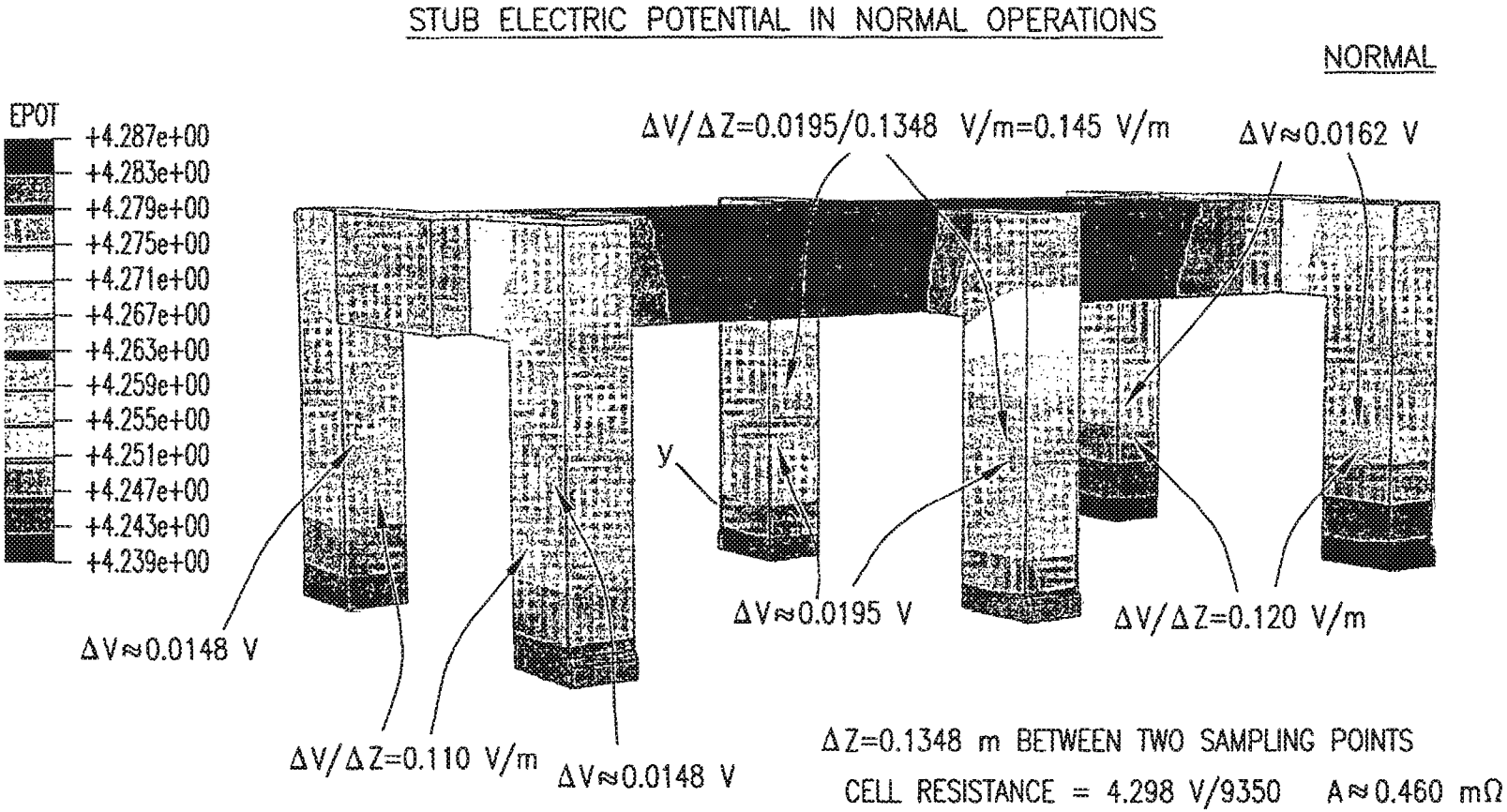

As illustrated in FIGS. 7-8, the electrical current supplied to anode X passes through the anode electrical connection (280), the current supply (290), and one of the current supply stubs (295) into the corresponding anode distributor plate (110). According to embodiments of the present invention, a voltage drop associated with anode X may be detected at various points of this electrical path. For example, FIG. 11 illustrates voltage drops measured at known points of each of the current supply stubs (295). In particular, as illustrated in FIG. 11, under normal operation conditions, a voltage drop measured across current supply stub "Y" is 0.0195 volts (V).

FIGS. 12-21 illustrate embodiments of the present invention by simulating cases where anode X undergoes an electrical short. In some embodiments, the electrical short simulated in FIGS. 12-21 simulates the effects of a thermite reaction at anode X.

Figure 12:
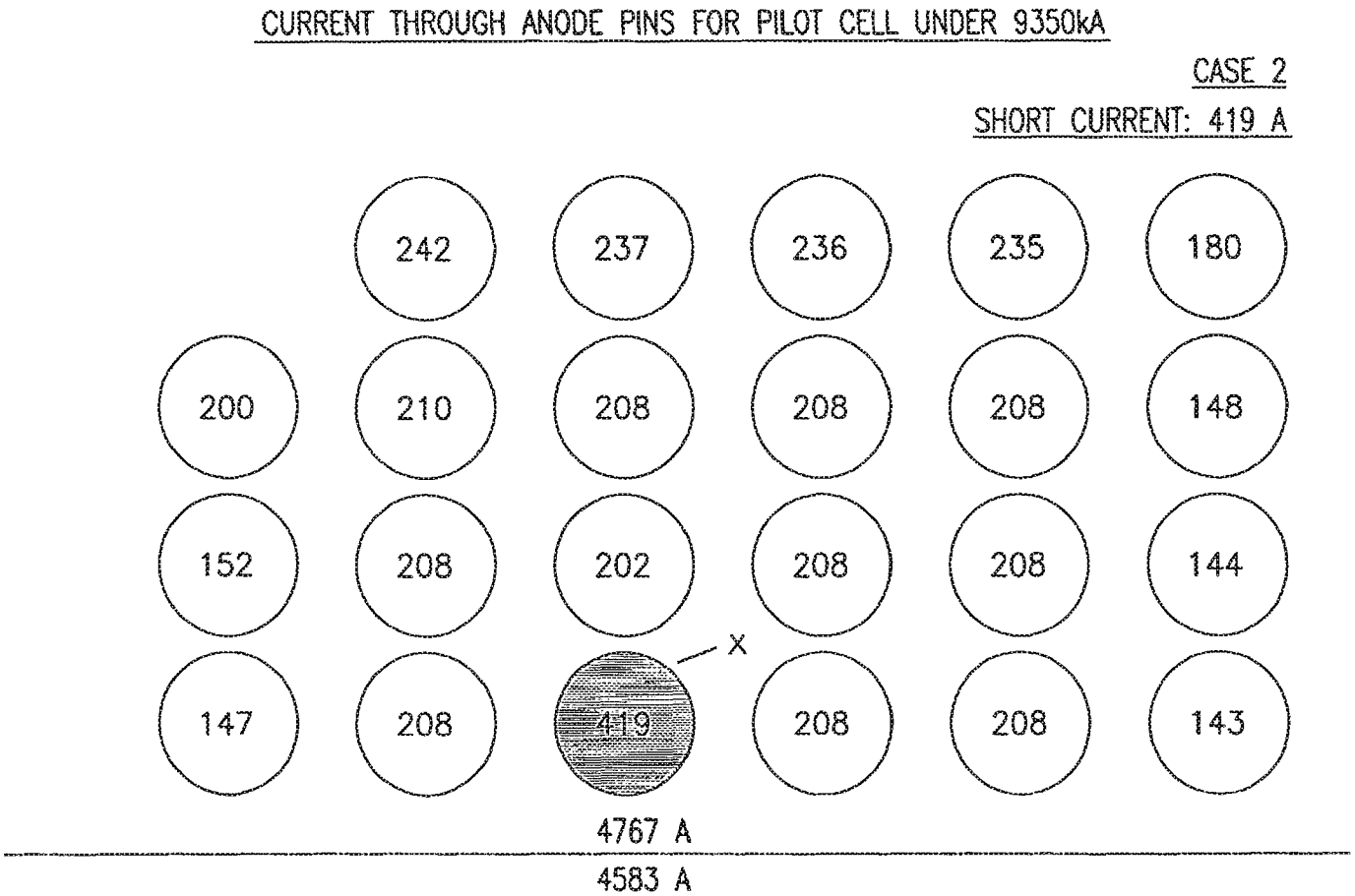
Figure 13:
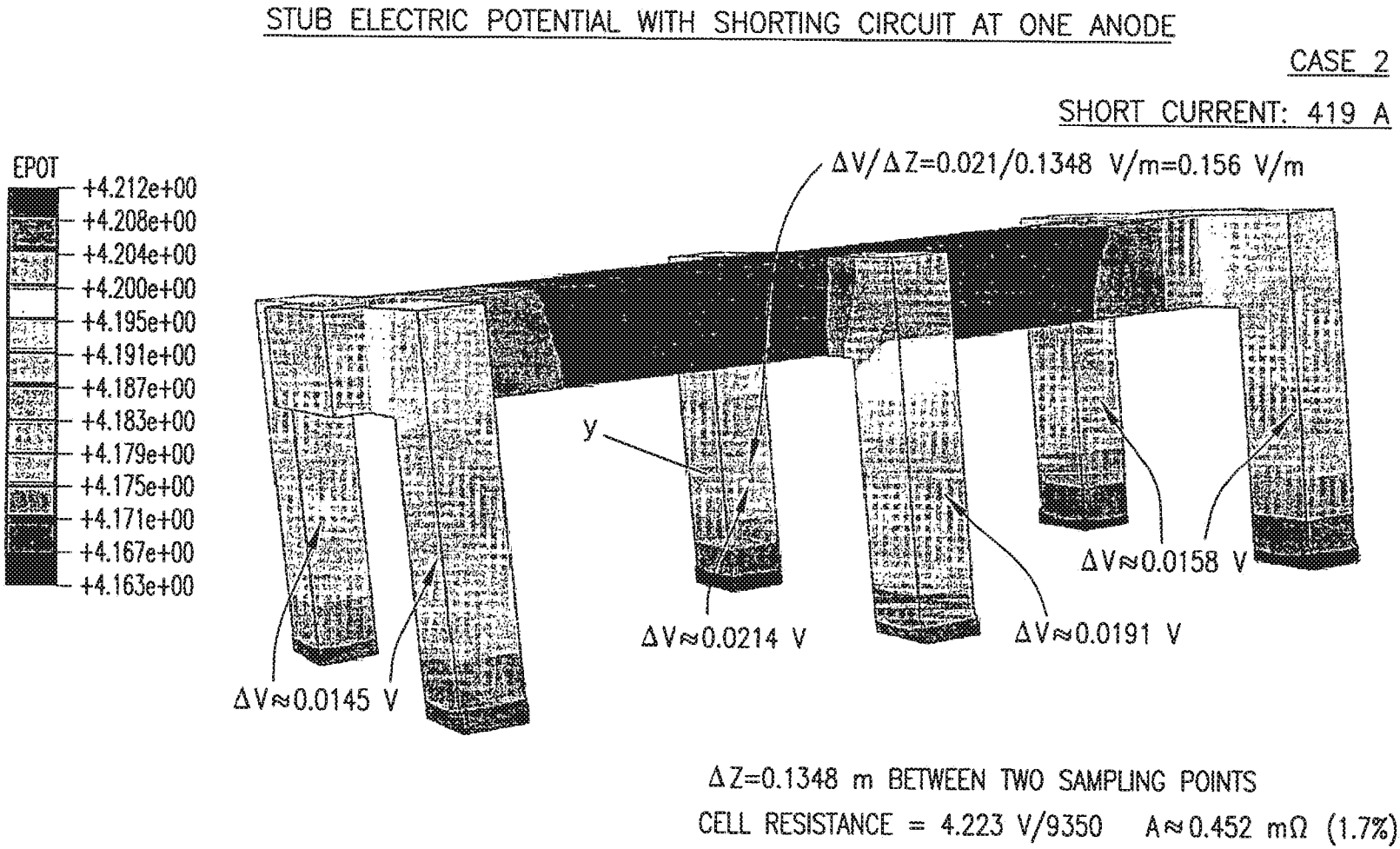

As illustrated in FIG. 12, in one model (case 2) an electrical short at anode X causes the current flowing through anode X to increase to 419 A. Correspondingly, as illustrated in FIG. 13, a voltage drop measured across current supply stub "Y" increases to 0.0214 volts (V) when the current to anode X increases to 419 A.

Figure 14:
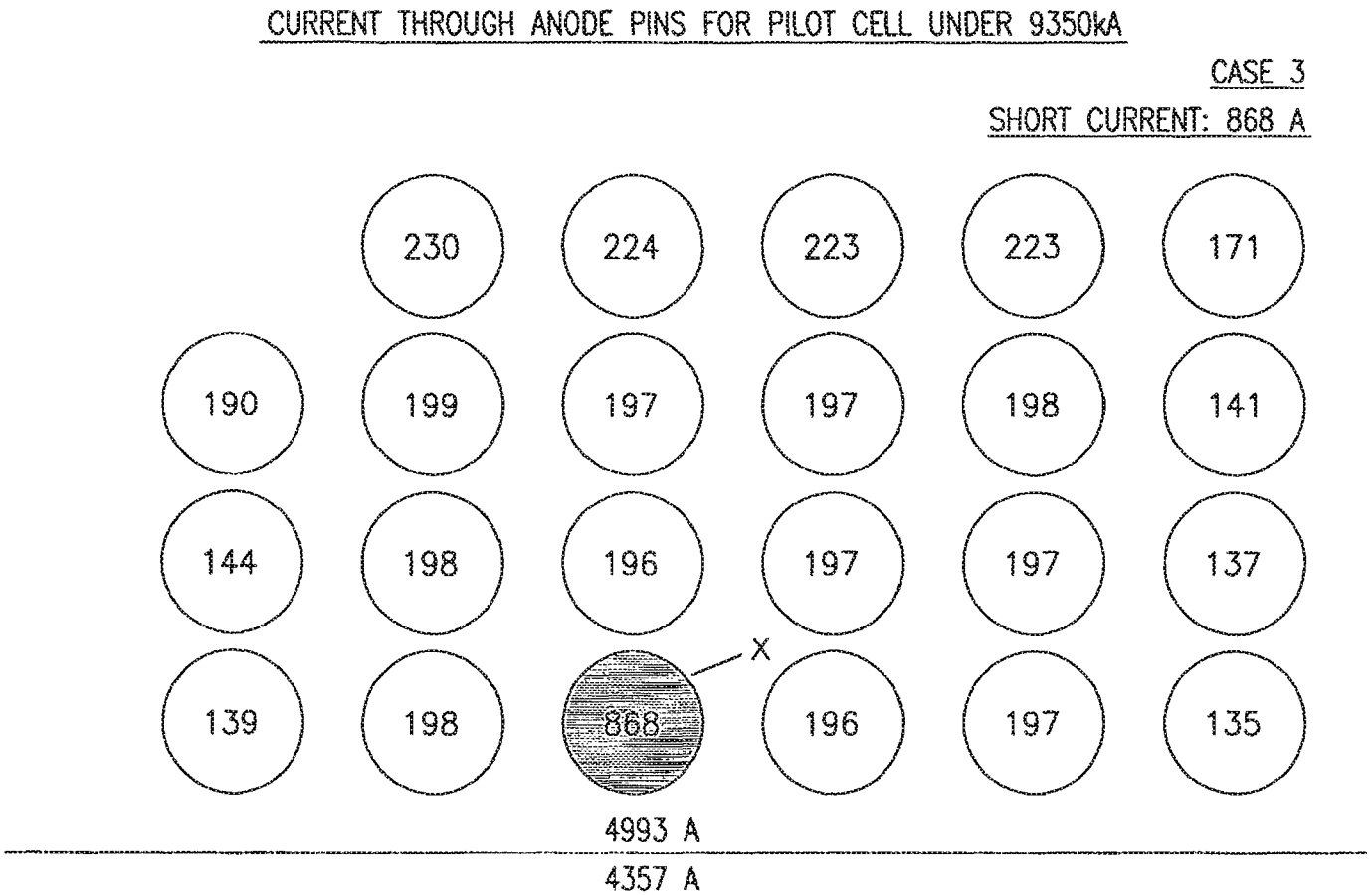
Figure 15:
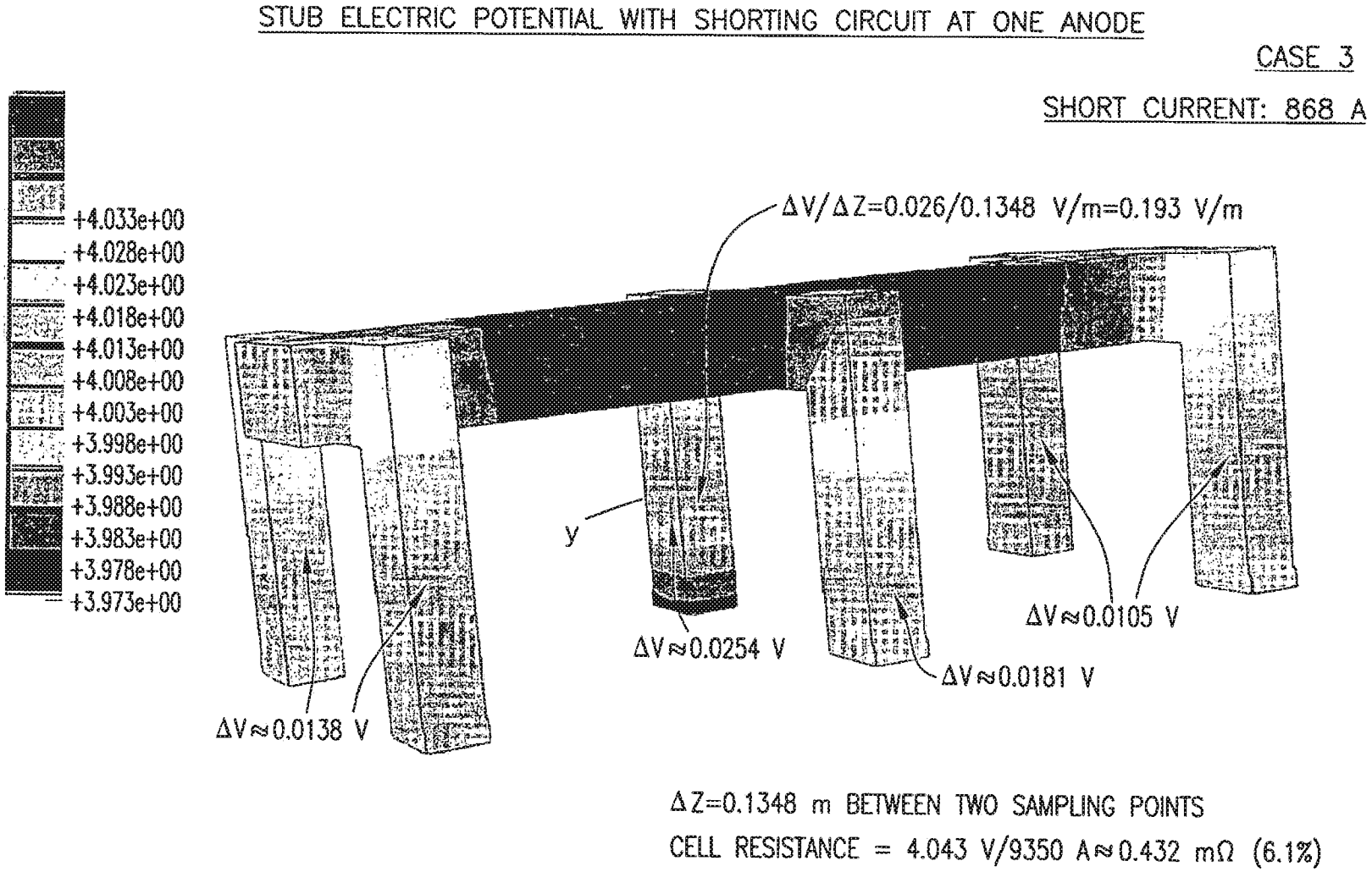

As illustrated in FIG. 14, in one model (case 3) an electrical short at anode X causes the current flowing through anode X to increase to 868 A. Correspondingly, as illustrated in FIG. 15, a voltage drop measured across current supply stub "Y" increases to 0.0254 volts (V) when the current to anode X increases to 868 A.

Figure 16:
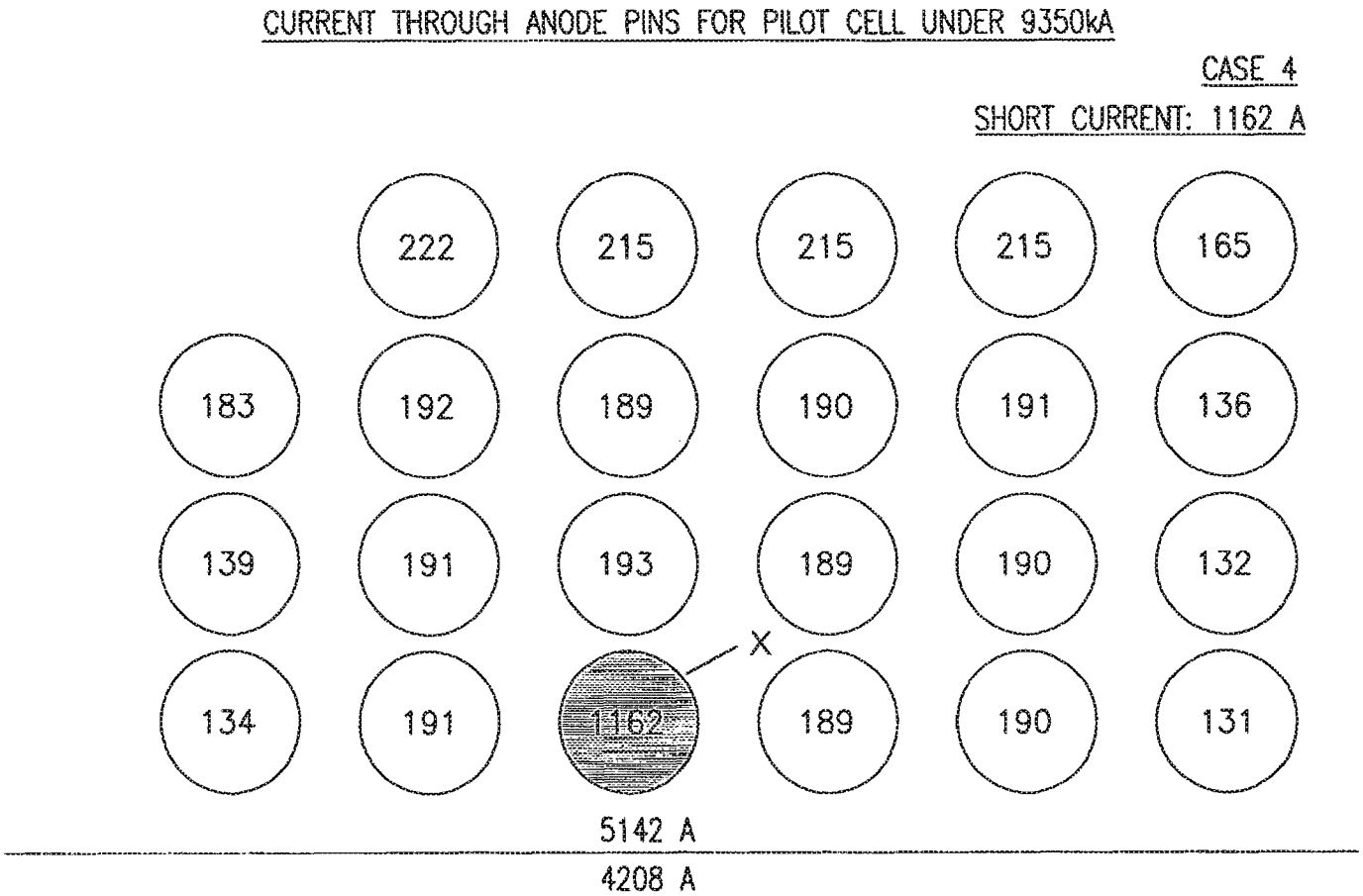
Figure 17:
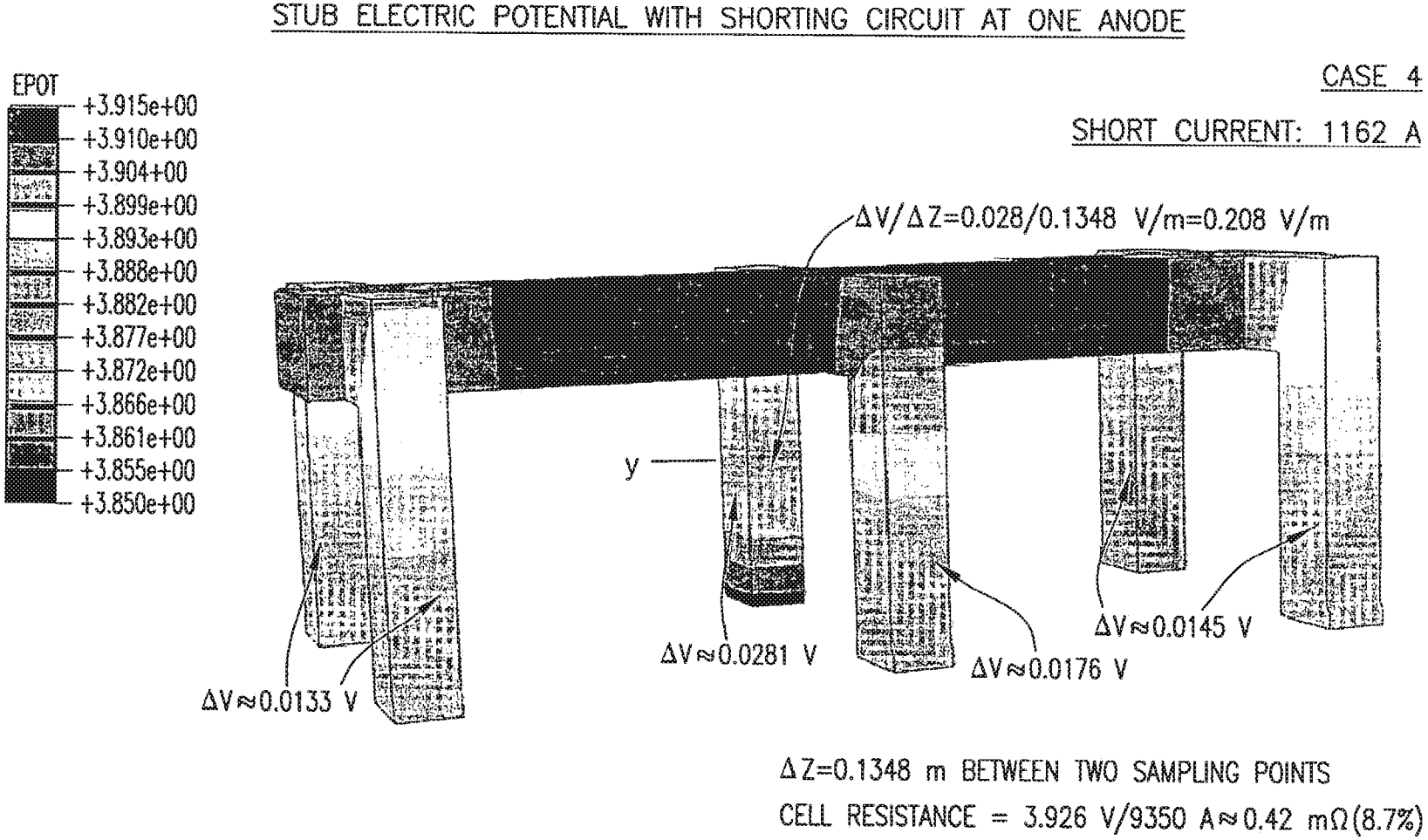

As illustrated in FIG. 16, in one model (case 4) an electrical short at anode X causes the current flowing through anode X to increase to 1162 A. Correspondingly, as illustrated in FIG. 17, a voltage drop measured across current supply stub "Y" increases to 0.0281 volts (V) when the current to anode X increases to 1162 A.

Figure 18:
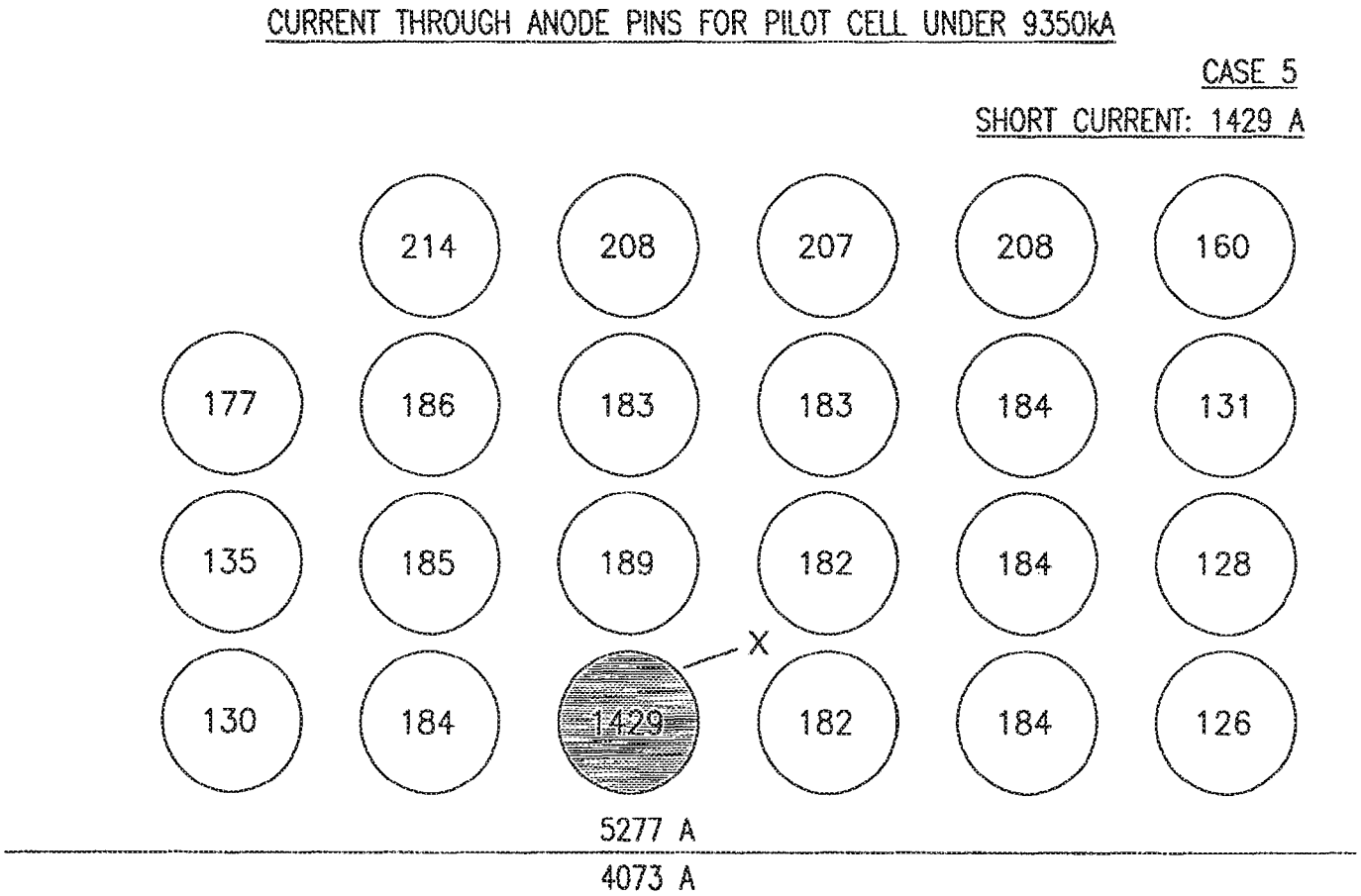
Figure 19:
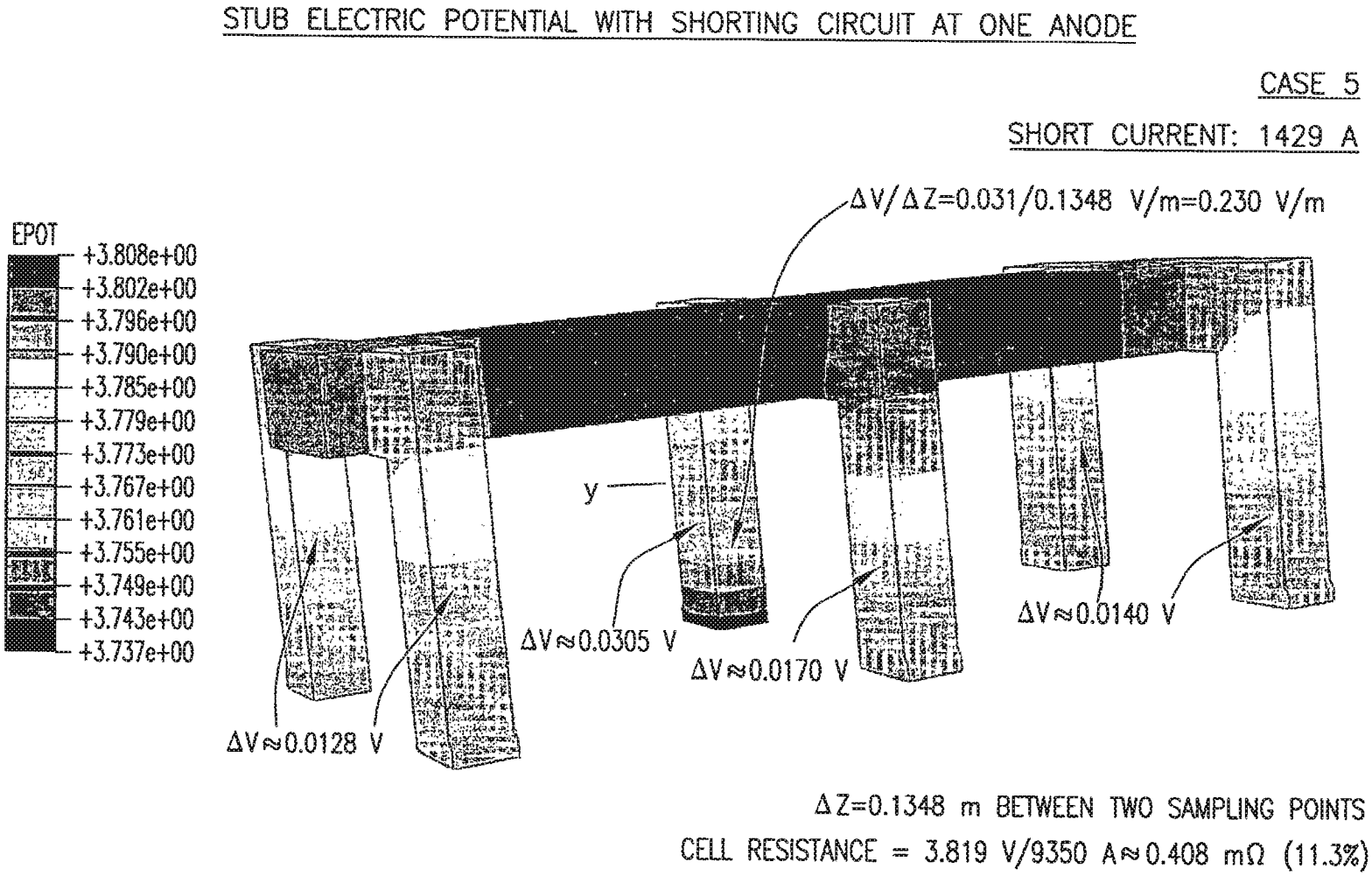

As illustrated in FIG. 18, in one model (case 5) an electrical short at anode X causes the current flowing through anode X to increase to 1429 A. Correspondingly, as illustrated in FIG. 19, a voltage drop measured across current supply stub "Y" increases to 0.0305 volts (V) when the current to anode X increases to 1429 A.

Figure 20:
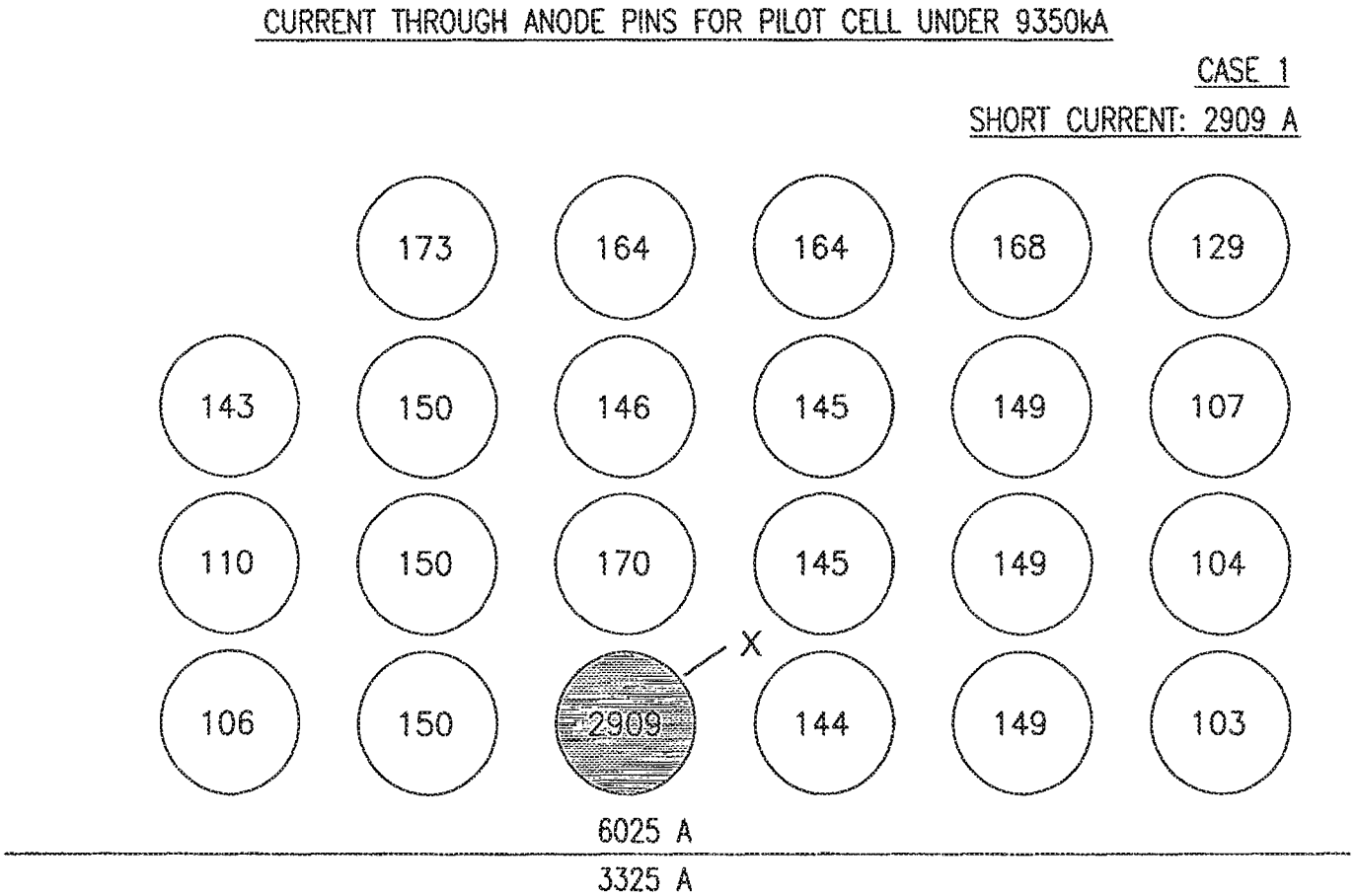
Figure 21:
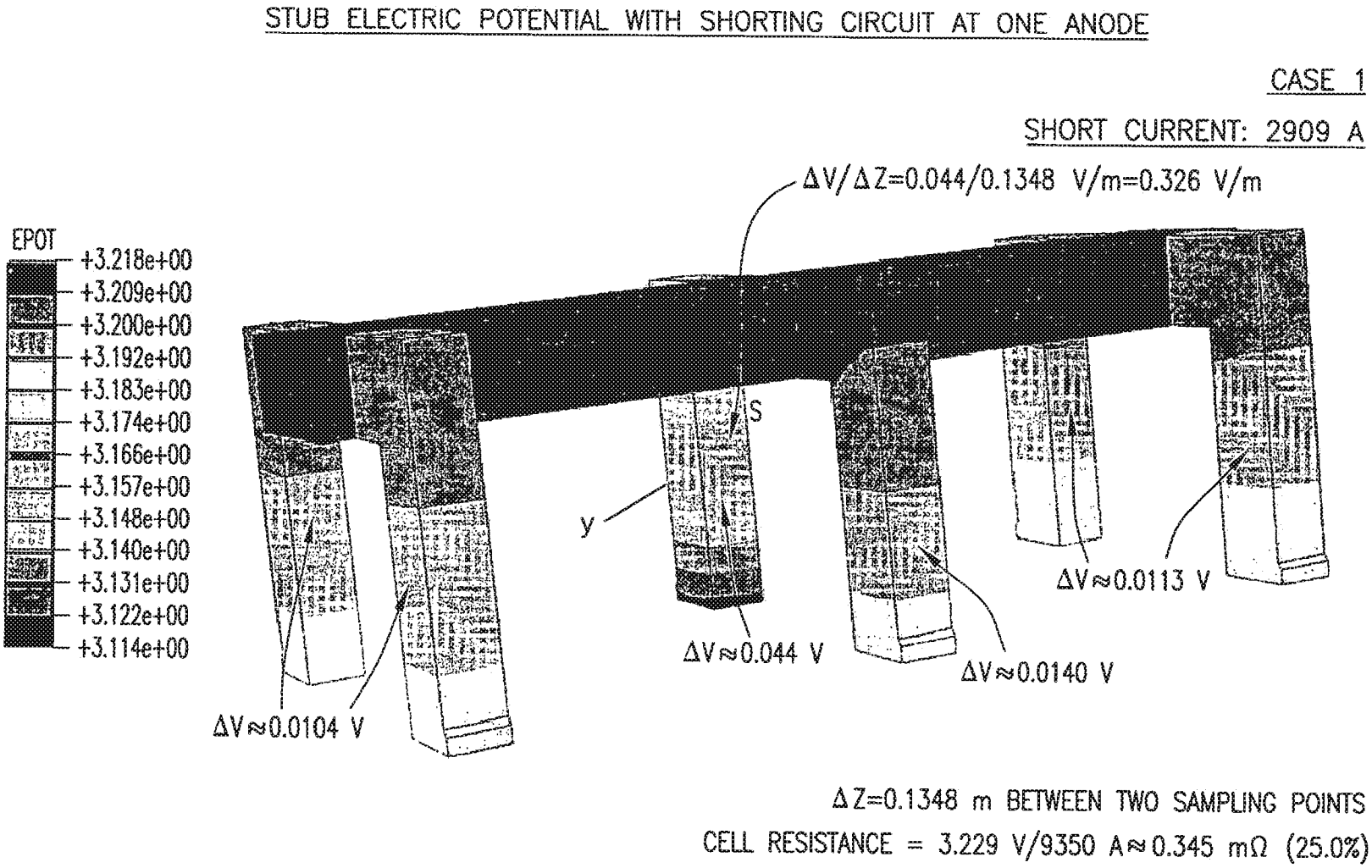
Figure 23:
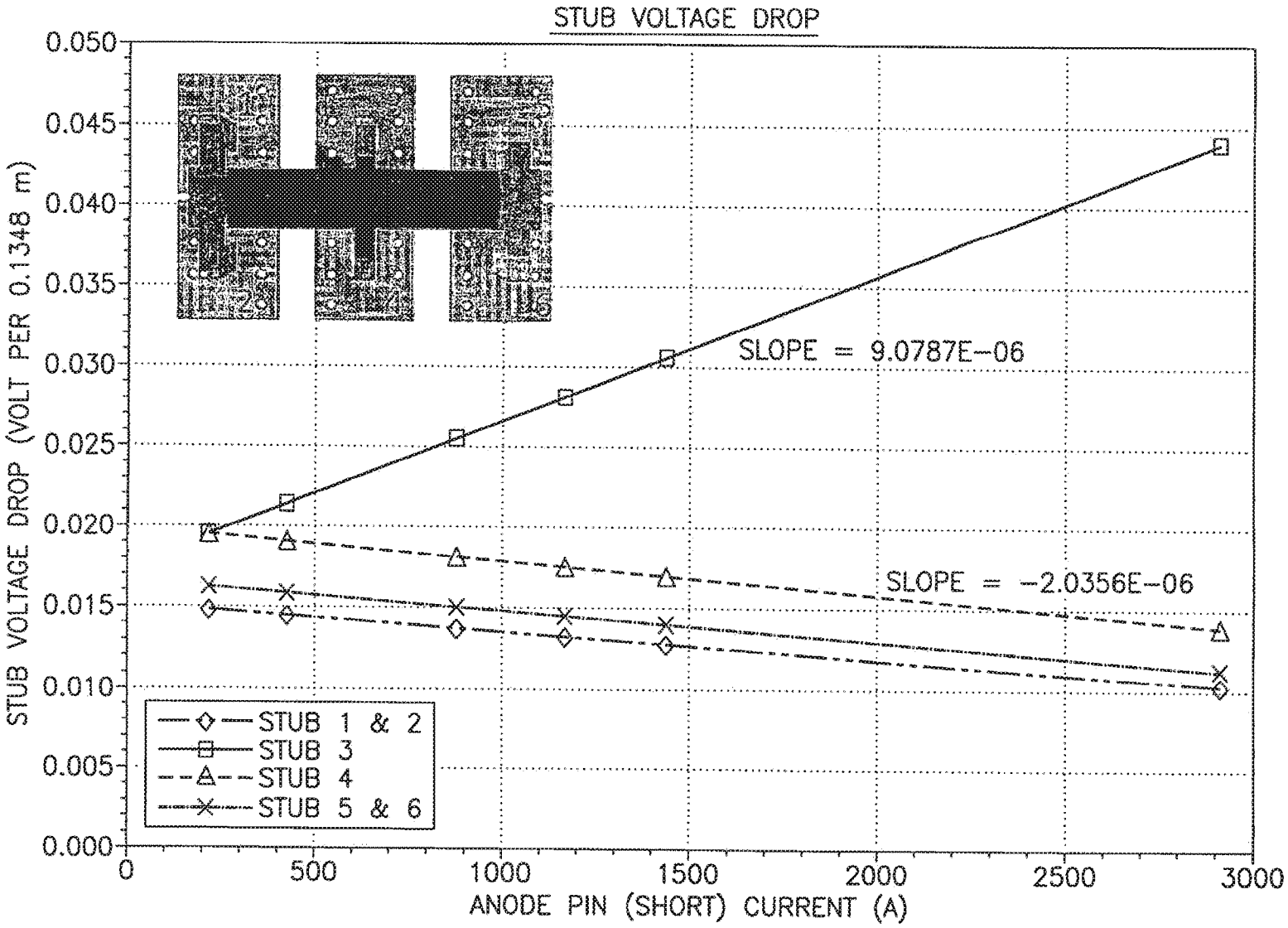
Figure 24:
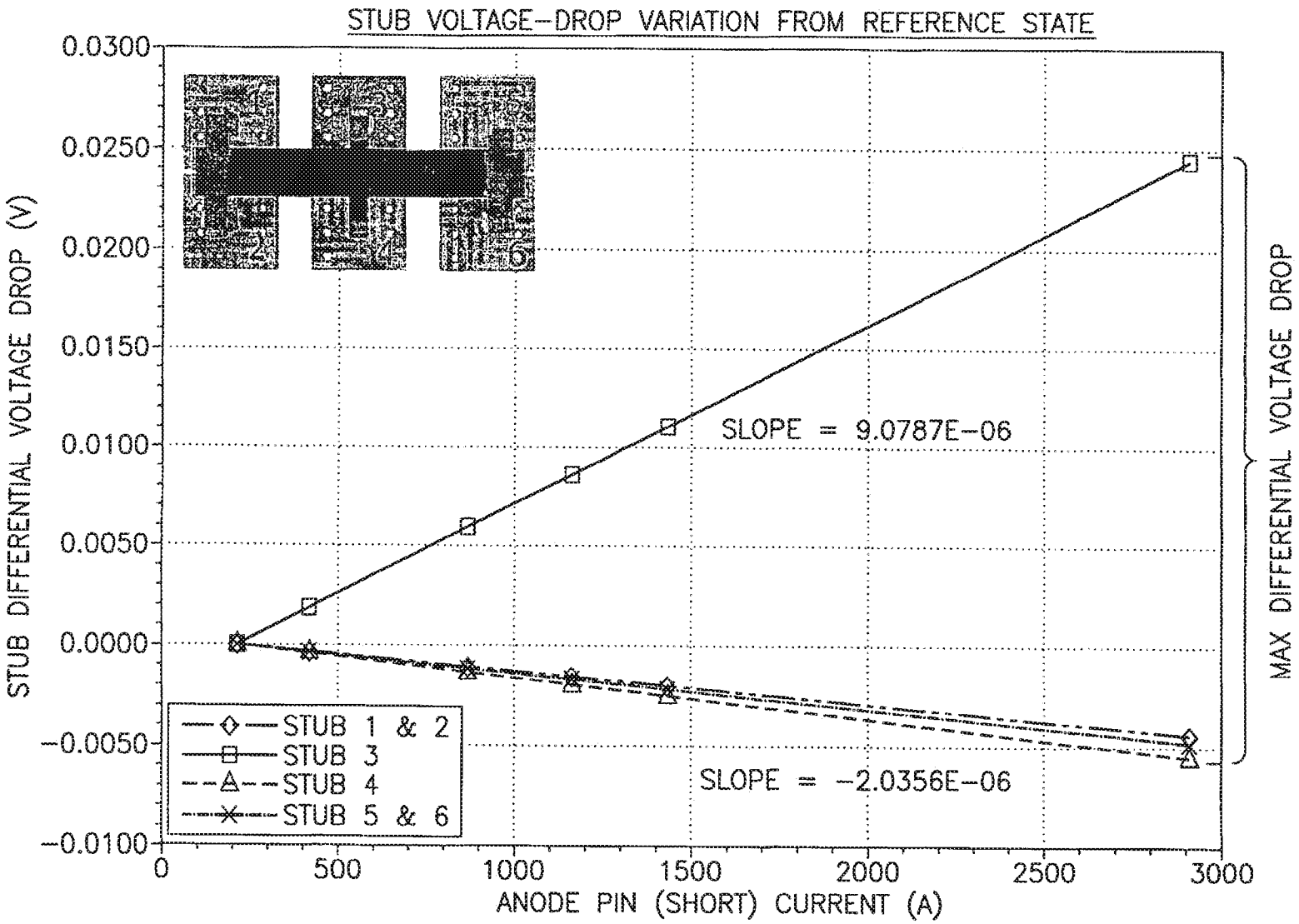
Figure 25:
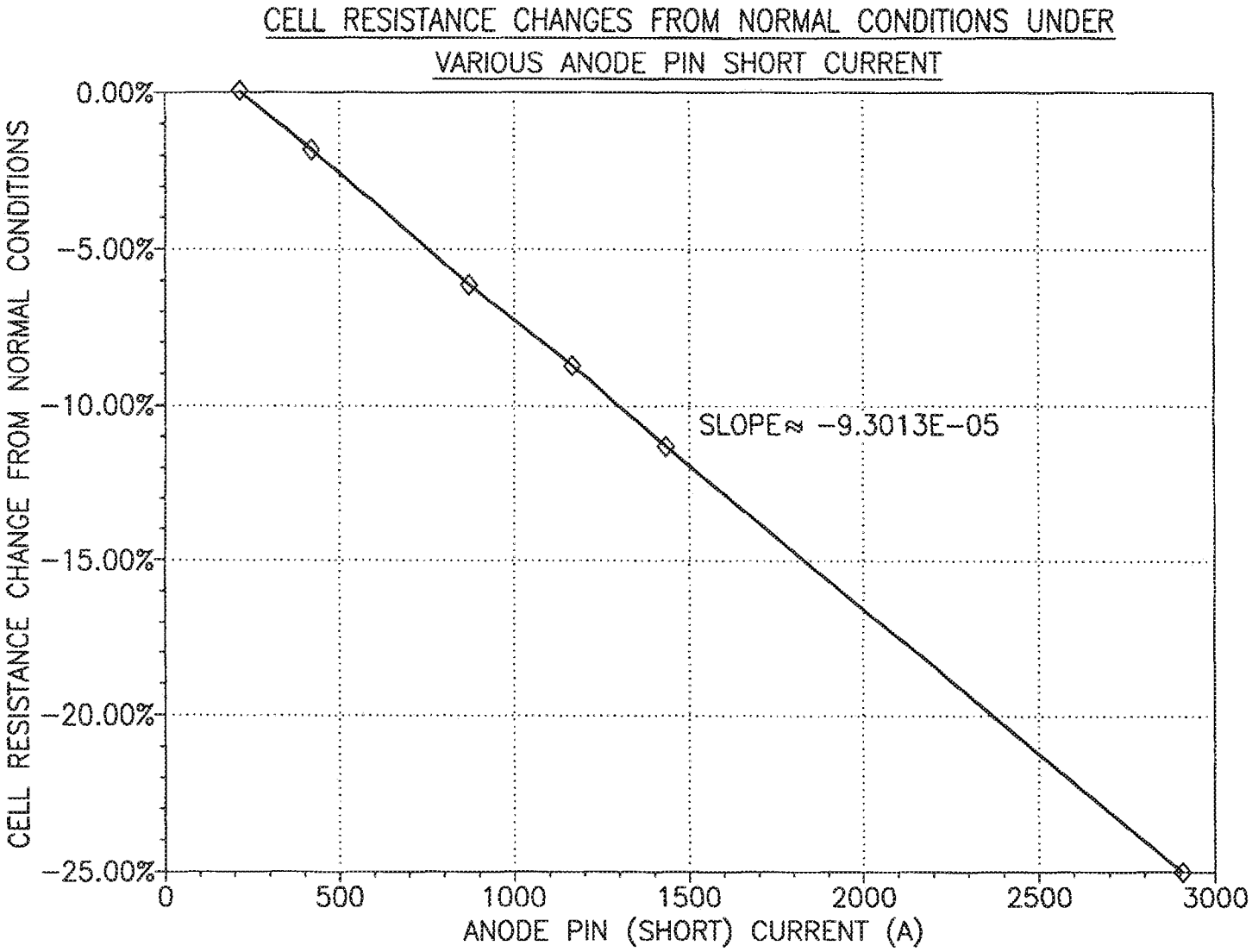
Figure 26:
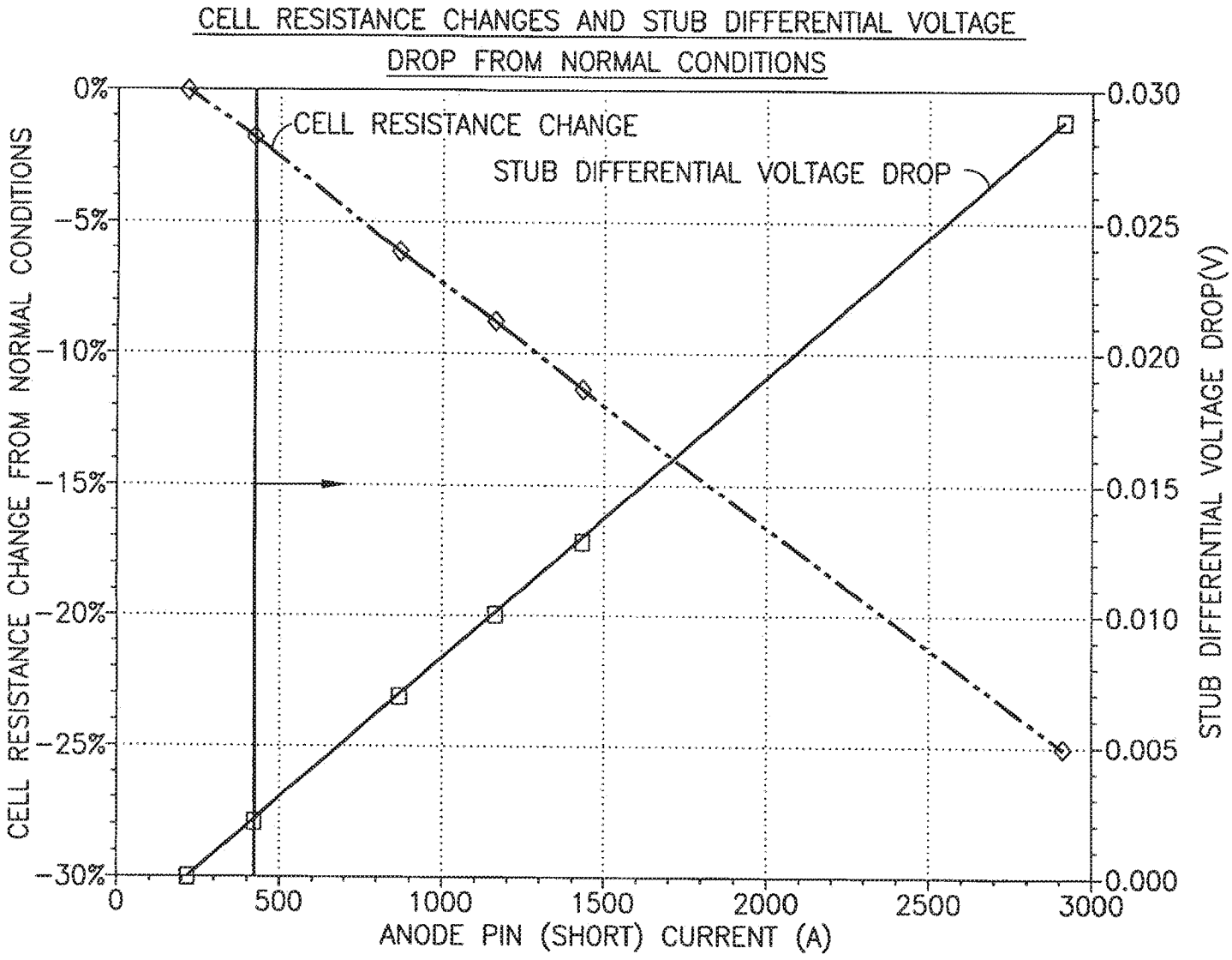
Figure 27:
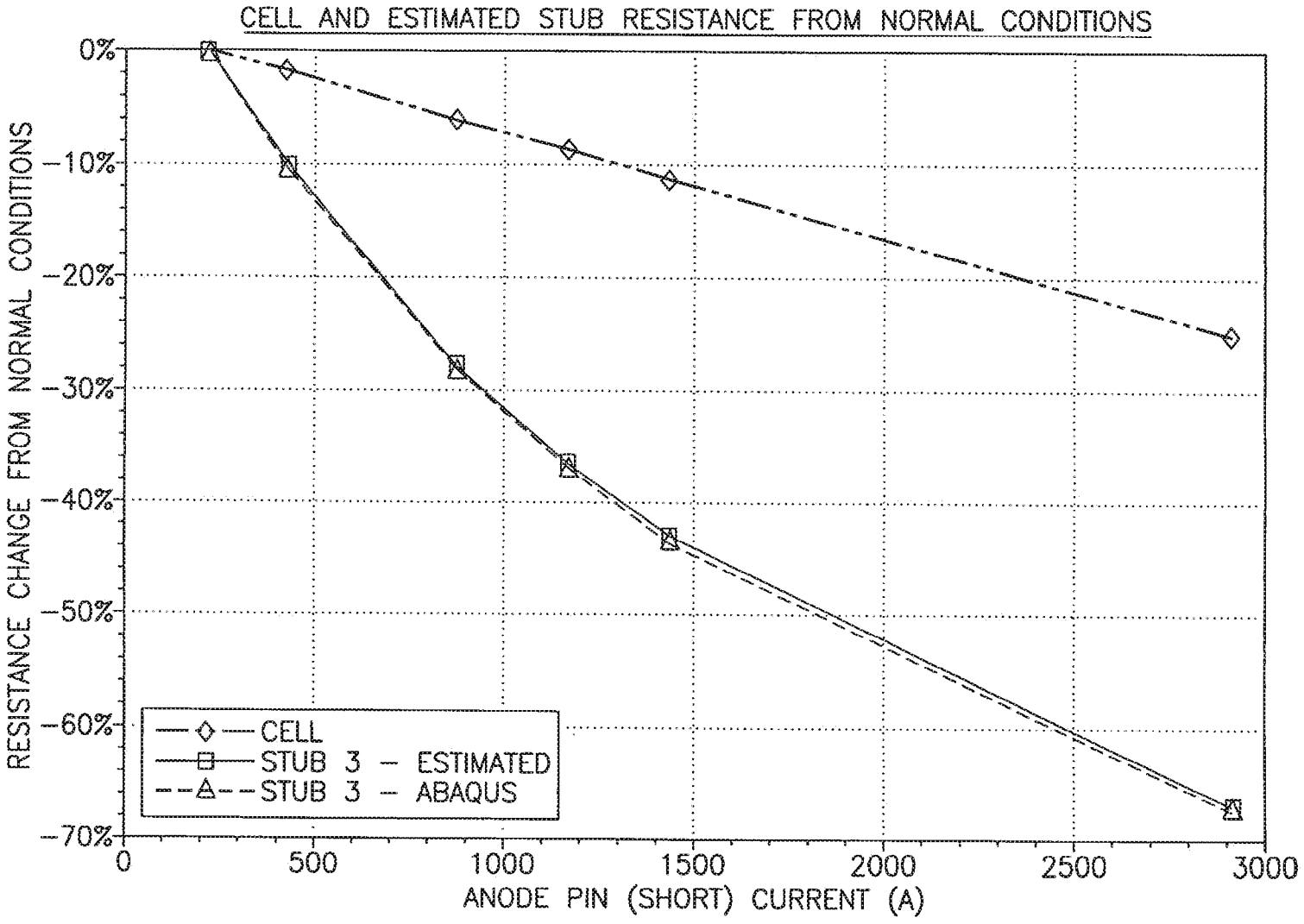

As illustrated in FIG. 20, in one model (case 1) an electrical short at anode X causes the current flowing through anode X to increase to 2909 A. Correspondingly, as illustrated in FIG. 21, a voltage drop measured across current supply stub "Y" increases to 0.044 volts (V) when the current to anode X increases to 2909 A.

FIGS. 22-27 summarize the data of FIGS. 10-21.

As illustrated in FIG. 22-27, a voltage drop increase measured at the current supply stub (295) corresponding to anode X (current supply stub "Y") can be used to detect an increase in electrical current at anode X.

In addition, because a constant electrical current supply is balanced, other measurements associated with the anode assembly (101) can be used to both confirm the measurements associated with anode X.

For example, as illustrated in FIG. 22; and increase in electrical current flowing through anode X increases the voltage drop detected in current supply stub "Y" (STUB 3). Similarly, the corresponding decrease in voltage drop associated with the other current supply stubs (295) (STUBS 1-2 and 4-6) confirm that the voltage drop detected in current supply stub "Y is not a false reading. In other embodiments, the validity of the voltage drop detected in current supply stub "Y" may be confirmed by measuring corresponding decreases in the overall electrolytic cell resistance (CELL RESISTANCE) or increase in anode distribution plate potential.

Some embodiments of the present invention can be written as computer programs and can be implemented in general-use digital computers that execute the programs using a computer readable recording medium. Examples of the computer readable recording medium include magnetic storage media (e.g., ROM, floppy disks, hard disks, etc.), optical recording media (e.g., CD-ROMs, or DVDs), and storage media such as carrier waves (e.g., transmission through the Internet).

Although a few embodiments of the present invention have been shown and described, it will be appreciated by those skilled in the art that changes may be made in these embodiments without departing from the principles and spirit of the present invention, the scope of which is defined in the appended claims and their equivalents.

What is claimed is:

1. A system for the detection and/or prevention of thermite reactions in an electrolytic cell comprising a cathode, an anode assembly comprising one or more anode distributor plates and an electrolytic bath, the system comprising:

one or more voltage probes configured to measure a voltage across an anode distributor plate, wherein the one or more voltage probes are attached to only one anode assembly at one or more respective locations to detect voltage information indicative of a thermite reaction, wherein the anode distributor plate is configured to attach to and electrically communicate with a group of metal oxide anodes;

a monitoring device operatively connected to the one or more voltage probes and configured to:

receive the voltage information from the one or more voltage probes, compare the voltage information to a threshold voltage drop, wherein the threshold voltage drop is a voltage drop level previously associated with a thermite reaction, wherein the threshold voltage drop is a rate of voltage drop increase, and generate a thermite response signal when the voltage information matches or exceeds the threshold voltage; and a control system in communication with the monitoring device and configured to cause, in response to the thermite response signal, at least one adjustment in at least one operational parameter of the electrolytic cell to suppress the thermite reaction.

2. A system for monitoring an electrolytic cell comprising an anode, a cathode and an electrolytic bath, the system comprising:

a plurality of voltage probes configured to measure a voltage drop between two points on the anode to detect voltage drop information indicative of a thermite reaction;

a monitoring device operatively connected to the plurality of voltage probes and configured to:

receive the voltage drop information from the plurality of voltage probes;

compare the voltage drop information to a threshold voltage drop, wherein the threshold voltage drop is a voltage drop level previously associated with a thermite reaction, and wherein the threshold voltage drop is a rate of voltage drop increase; and generate a thermite response signal when the voltage information matches or exceeds the threshold voltage; and a control system in communication with the monitoring device and configured to cause, in response to the thermite response signal, at least one adjustment in at least one operational parameter of the electrolysis to suppress the thermite reaction.

3. The system of claim 1, wherein the one or more voltage probes are configured to measure the voltage drop from a plurality of anode distributor plates, wherein each anode distributor plate is configured to attach to an electrically communicate with the group of metal oxide anodes.

4. The system of claim 3, wherein the voltage information indicative of a thermite reaction comprises information related to an electrical current passing through the one or more anodes of the group of metal oxide anodes.

5. The system of claim 4, wherein the voltage information indicative of a thermite reaction comprises at least one of a magnetic field associated with one or more anodes of the group of metal oxide anodes, and electrical field associated with the one or more anodes, and a voltage associated with the one or more anodes.

6. The system of claim 5, wherein the voltage information indicative of a thermite reaction comprises a voltage drop associated with one or more anodes of the group of metal oxide anodes.

7. The system of claim 6, wherein the voltage drop is detected across known points in each of one or more anodes of the group of metal oxide anodes.

8. The system of claim 6, wherein the voltage drop is detected across known point in an anode distribution plate supporting a group of one or more anodes of the group of metal oxide anodes.

9. The system of claim 6, wherein the voltage drop is detected across known point in an anode assembly supporting one or more anodes of the group of metal oxide anodes or one or more anode distribution plates.

10. The system of claim 9, wherein the voltage drop is detected across the anode assembly supporting the plurality of distributor plates, with each distributor plate configured to attach to a respective group of anodes.

* * * * *